US006840316B2

(12) United States Patent
Stegemeier et al.

(10) Patent No.: US 6,840,316 B2
(45) Date of Patent: Jan. 11, 2005

(54) TRACKER INJECTION IN A PRODUCTION WELL

(75) Inventors: George Leo Stegemeier, Houston, TX (US); Harold J. Vinegar, Houston, TX (US); Robert Rex Burnett, Katy, TX (US); William Mountjoy Savage, Houston, TX (US); Frederick Gordon Carl, Jr., Houston, TX (US); John Michele Hirsch, Houston, TX (US)

(73) Assignee: Shell Oil Company, Houston, TX (US)

( * ) Notice: Subject to any disclaimer, the term of this patent is extended or adjusted under 35 U.S.C. 154(b) by 208 days.

(21) Appl. No.: 10/220,251

(22) PCT Filed: Mar. 2, 2001

(86) PCT No.: PCT/US01/06800

§ 371 (c)(1),
(2), (4) Date: Aug. 29, 2002

(87) PCT Pub. No.: WO01/65053

PCT Pub. Date: Sep. 7, 2001

(65) Prior Publication Data

US 2003/0056952 A1 Mar. 27, 2003

Related U.S. Application Data

(60) Provisional application No. 60/177,999, filed on Jun. 24, 2000, provisional application No. 60/178,000, filed on Jun. 24, 2000, provisional application No. 60/178,001, filed on Jun. 24, 2000, provisional application No. 60/177,883, filed on Jun. 24, 2000, provisional application No. 60/177,998, filed on Jun. 24, 2000, provisional application No. 60/177,997, filed on Jun. 24, 2000, provisional application No. 60/181,322, filed on Feb. 9, 2000, provisional application No. 60/186,376, filed on Mar. 2, 2000, provisional application No. 60/186,380, filed on Mar. 2, 2000, provisional application No. 60/186,505, filed on Mar. 2, 2000, provisional application No. 60/186,504, filed on Mar. 2, 2000, provisional application No. 60/186,379, filed on Mar. 2, 2000, provisional application No. 60/186,394, filed on Mar. 2, 2000, provisional application No. 60/186,382, filed on Mar. 2, 2000, provisional application No. 60/186,503, filed on Mar. 2, 2000, provisional application No. 60/186,527, filed on Mar. 2, 2000, provisional application No. 60/186,393, filed on Mar. 2, 2000, provisional application No. 60/186,394, filed on Mar. 2, 2000, provisional application No. 60/186,531, filed on Mar. 2, 2000, provisional application No. 60/186,377, filed on Mar. 2, 2000, provisional application No. 60/186,381, filed on Mar. 2, 2000, and provisional application No. 60/186,378, filed on Mar. 2, 2000.

(51) Int. Cl.[7] ..... E21B 47/00

(52) U.S. Cl. ..... 166/250.12; 166/66; 166/252.6

(58) Field of Search ..... 166/66, 250.12, 166/252.6, 65.1

(56) References Cited

U.S. PATENT DOCUMENTS 525,663 A 9/1894 Mottinger (List continued on next page.)

FOREIGN PATENT DOCUMENTS

EP 28296 5/1981 ..... E21B/47/12

(List continued on next page.)

OTHER PUBLICATIONS

Brown.Connolizo and Robertson, West Texas Oil Lifting Short Course and H.W. Winkler, "Misunderstood or overlooked Gas–Lift Design and Equipment Considerations," SPE, p. 351 (1994).

(List continued on next page.)

*Primary Examiner*—Hoang Dang

(57) ABSTRACT

A petroleum well having a well casing, a production tubing, a source of time-varying current, a downhole tracer injection device, and a downhole induction choke. The casing extends within a wellbore of the well. The tubing extends within the casing. The current source is located at the surface. The current source is electrically connected to, and adapted to output a time-varying current into, the tubing and/or the casing, which act as electrical conductors for providing downhole power and/or communications to the injection device. The injection device having a communications and control module, a tracer material reservoir, and an electrically controllable tracer injector.

33 Claims, 26 Drawing Sheets

U.S. PATENT DOCUMENTS

| | | | | | |
|---|---|---|---|---|---|
| 2,917,004 | A | | 12/1959 | Davis et al. | |
| 3,083,771 | A | | 4/1963 | Chapman | |
| 3,247,904 | A | | 4/1966 | Wakefield, Jr. | |
| 3,427,989 | A | | 2/1969 | Bostock et al. | |
| 3,566,963 | A | | 3/1971 | Blackledge | 166/189 |
| 3,602,305 | A | | 8/1971 | Kisling, III | 116/134 |
| 3,732,728 | A | | 5/1973 | Fitzpatrick | 73/151 |
| 3,793,632 | A | | 2/1974 | Still | 340/18 |
| 3,814,545 | A | | 6/1974 | Waters | 417/90 |
| 3,837,618 | A | | 9/1974 | Juhel | 251/129 |
| 3,980,826 | A | | 9/1976 | Widmer | 178/68 |
| 4,068,717 | A | | 1/1978 | Needham | 166/272 |
| 4,087,781 | A | | 5/1978 | Grossi et al. | 340/18 |
| 4,295,795 | A | | 10/1981 | Gass et al. | 417/111 |
| 4,393,485 | A | | 7/1983 | Redden | 367/25 |
| 4,468,665 | A | | 8/1984 | Thawley et al. | 340/856 |
| 4,545,731 | A | | 10/1985 | Canalizo et al. | 417/86 |
| 4,576,231 | A | | 3/1986 | Dowling et al. | 166/248 |
| 4,578,675 | A | | 3/1986 | MacLeod | 340/855 |
| 4,596,516 | A | | 6/1986 | Scott et al. | 417/58 |
| 4,630,243 | A | | 12/1986 | MacLeod | 367/82 |
| 4,648,471 | A | | 3/1987 | Bordon | 175/4.55 |
| 4,662,437 | A | | 5/1987 | Renfro | 166/65.1 |
| 4,681,164 | A | | 7/1987 | Stacks | 166/304 |
| 4,709,234 | A | | 11/1987 | Forehand et al. | 340/856 |
| 4,738,313 | A | | 4/1988 | McKee | 166/372 |
| 4,739,325 | A | | 4/1988 | MacLeod | 340/854 |
| 4,771,635 | A | * | 9/1988 | Trevillion | 73/152.29 |
| 4,793,414 | A | * | 12/1988 | Nguyen et al. | 166/252.6 |
| 4,839,644 | A | | 6/1989 | Safinya et al. | 340/854 |
| 4,886,114 | A | | 12/1989 | Perkins et al. | 166/65.1 |
| 4,901,069 | A | | 2/1990 | Veneruso | 340/853 |
| 4,972,704 | A | | 11/1990 | Wellington et al. | 73/155 |
| 4,981,173 | A | | 1/1991 | Perkins et al. | 166/66.4 |
| 5,001,675 | A | | 3/1991 | Woodward | 367/13 |
| 5,008,664 | A | | 4/1991 | More et al. | |
| 5,130,706 | A | | 7/1992 | Van Steenwyk | 340/854.6 |
| 5,134,285 | A | | 7/1992 | Perry et al. | 250/269 |
| 5,160,925 | A | | 11/1992 | Dailey et al. | 340/853.3 |
| 5,162,740 | A | | 11/1992 | Jewell | 324/347 |
| 5,172,717 | A | | 12/1992 | Boyle et al. | 137/155 |
| 5,176,164 | A | | 1/1993 | Boyle | 137/155 |
| 5,191,326 | A | | 3/1993 | Montgomery | 340/855.5 |
| 5,230,383 | A | | 7/1993 | Pringle et al. | 166/66.4 |
| 5,246,860 | A | | 9/1993 | Hutchins et al. | 436/27 |
| 5,251,328 | A | | 10/1993 | Shaw | 455/73 |
| 5,257,663 | A | | 11/1993 | Pringle et al. | 166/66.4 |
| 5,267,469 | A | | 12/1993 | Espinoza | 73/40.5 |
| 5,278,758 | A | | 1/1994 | Perry et al. | 364/422 |
| 5,331,318 | A | | 7/1994 | Montgomery | 340/855.4 |
| 5,353,627 | A | | 10/1994 | Diatschenko et al. | 73/19.03 |
| 5,358,035 | A | | 10/1994 | Grudzinski | 166/53 |
| 5,367,694 | A | | 11/1994 | Ueno | 395/800 |
| 5,394,141 | A | | 2/1995 | Soulier | 340/854.4 |
| 5,396,232 | A | | 3/1995 | Mathieu et al. | 340/854.5 |
| 5,425,425 | A | | 6/1995 | Bankston et al. | 166/377 |
| 5,447,201 | A | | 9/1995 | Mohn | 166/375 |
| 5,458,200 | A | | 10/1995 | Lagerlef et al. | 166/372 |
| 5,467,083 | A | | 11/1995 | McDonald et al. | 340/854.6 |
| 5,473,321 | A | | 12/1995 | Goodman et al. | 340/854.9 |
| 5,493,288 | A | | 2/1996 | Henneuse | 340/854.4 |
| 5,531,270 | A | | 7/1996 | Fletcher et al. | 166/53 |
| 5,561,245 | A | | 10/1996 | Georgi et al. | 73/152.02 |
| 5,574,374 | A | | 11/1996 | Thompson et al. | 324/338 |
| 5,576,703 | A | | 11/1996 | MacLeod et al. | 340/854.4 |
| 5,587,707 | A | | 12/1996 | Dickie et al. | 340/870.09 |
| 5,592,438 | A | | 1/1997 | Rorden et al. | 367/83 |
| 5,662,165 | A | | 9/1997 | Tubel et al. | 166/250.01 |
| 5,723,781 | A | * | 3/1998 | Pruett et al. | 73/152.18 |
| 5,730,219 | A | | 3/1998 | Tubel et al. | 66/250.01 |
| 5,745,047 | A | | 4/1998 | Van Gisbergen et al. | 340/853.1 |
| 5,782,261 | A | | 7/1998 | Becker et al. | 137/155 |
| 5,797,453 | A | | 8/1998 | Becker et al. | 166/117.5 |
| 5,881,807 | A | | 3/1999 | Boe et al. | |
| 5,883,516 | A | | 3/1999 | Van Steenwyk et al. | 324/366 |
| 5,887,657 | A | | 3/1999 | Bussear et al. | 166/336 |
| 5,896,924 | A | | 4/1999 | Carmody et al. | 166/53 |
| 5,934,371 | A | | 8/1999 | Bussear et al. | 166/53 |
| 5,937,945 | A | | 8/1999 | Bussear et al. | 166/250.15 |
| 5,941,307 | A | | 8/1999 | Tubel | 166/313 |
| 5,955,666 | A | | 9/1999 | Mullins | 73/52.18 |
| 5,959,499 | A | | 9/1999 | Khan et al. | 330/149 |
| 5,960,883 | A | | 10/1999 | Tubel et al. | 166/313 |
| 5,963,090 | A | | 10/1999 | Fukuchi | 330/149 |
| 5,971,072 | A | | 10/1999 | Huber et al. | 166/297 |
| 5,975,204 | A | | 11/1999 | Tubel et al. | 166/250.15 |
| 5,995,020 | A | | 11/1999 | Owens et al. | 340/854.9 |
| 6,012,015 | A | | 1/2000 | Tubel | 702/6 |
| 6,012,016 | A | | 1/2000 | Bilden et al. | 702/12 |
| 6,070,608 | A | | 6/2000 | Pringle | 137/155 |
| 6,123,148 | A | | 9/2000 | Oneal | 166/118 |
| 6,148,915 | A | | 11/2000 | Mullen et al. | 166/278 |
| 6,192,983 | B1 | | 2/2001 | Neuroth et al. | 166/250.15 |
| 6,208,586 | B1 | | 3/2001 | Rorden et al. | 367/35 |
| 6,334,486 | B1 | | 1/2002 | Carmody et al. | 166/53 |
| 6,349,766 | B1 | * | 2/2002 | Bussear et al. | 166/113 |
| 6,484,800 | B2 | | 11/2002 | Carmody et al. | 166/53 |
| 2003/0131991 | A1 | * | 7/2003 | Hartog et al. | 166/250.12 |

FOREIGN PATENT DOCUMENTS

| | | | | |
|---|---|---|---|---|
| EP | 295178 | A2 | 12/1988 | E21B/47/12 |
| EP | 339825 | | 11/1989 | E21B/47/12 |
| EP | 492856 | A2 | 7/1992 | H04B/1/62 |
| EP | 641916 | A2 | 3/1995 | E21B/33/124 |
| EP | 681090 | A2 | 11/1995 | E21B/47/18 |
| EP | 697500 | A2 | 2/1996 | E21B/49/00 |
| EP | 0 721 053 | | 7/1996 | E21B/47/12 |
| EP | 732053 | A1 | 9/1996 | A21C/9/04 |
| EP | 919696 | A2 | 6/1999 | E21B/47/12 |
| EP | 922835 | A2 | 6/1999 | E21B/43/14 |
| EP | 930518 | A2 | 7/1999 | G01V/3/12 |
| EP | 964134 | | 12/1999 | E21B/47/12 |
| EP | 972909 | A2 | 1/2000 | E21B/44/00 |
| EP | 999341 | A2 | 5/2000 | E21B/33/14 |
| FR | 2677134 | | 12/1992 | E21B/47/12 |
| GB | 2083321 | A | 3/1982 | H04B/5/00 |
| GB | 2325949 | A | 12/1998 | E21B/43/12 |
| GB | 2327695 | A | 2/1999 | E21B/43/12 |
| GB | 2338253 | A | 12/1999 | E21B/47/12 |
| WO | 80/00727 | | 4/1980 | E21B/47/12 |
| WO | 93/26115 | | 12/1993 | H04N/1/40 |
| WO | 96/00836 | | 1/1996 | E21B/47/12 |
| WO | 96/24747 | | 8/1996 | E21B/43/12 |
| WO | 97/16751 | | 5/1997 | G01V/3/00 |
| WO | 97/37103 | | 10/1997 | E21B/47/01 |
| WO | 98/20233 | | 5/1998 | E21B/43/40 |
| WO | 99/37044 | | 7/1999 | H04B/13/02 |
| WO | 99 57417 | | 11/1999 | E21B/41/00 |
| WO | 99/60247 | | 11/1999 | E21B/43/12 |
| WO | 00 37770 | | 6/2000 | E21B/37/06 |
| WO | 00/04275 | | 12/2000 | E21B/47/01 |
| WO | 01/20126 | A2 | 3/2001 | E21B/43/12 |
| WO | 01/55555 | A1 | 8/2001 | E21B/47/12 |

OTHER PUBLICATIONS

Der Spek, Alex, and Aliz Thomas, "Neural–Net Identification of Flow Regime with Band Spectra of Flow–Generated Sound", SPE Reservoir Eva. & ENg.2 (6) Dec. 1999, pp. 489–498.

Sakata et al., "Performance Analysis of Long Distance Transmitting of Magnetic Signal on Cylindrical Steel Rod", IEEE Translation Journal on magnetics in Japan, vol. 8, No. 2. Feb. 1993,, pps. 102–106.

Otis Engineering, Aug. 1980, "Heavy Crude Lift System", Field Development Report, OEC 5228, Otis Corp., Dallas, Texas, 1980.

* cited by examiner

TRACKER INJECTION IN A PRODUCTION WELL

CROSS-REFERENCES TO RELATED APPLICATIONS

This application claims the benefit of the following U.S. Provisional Applications, all of which are hereby incorporated by reference:

COMMONLY OWNED AND PREVIOUSLY FILED U.S. PROVISIONAL PATENT APPLICATIONS

| T&K # | Serial Number | Title | Filing Date |
|---|---|---|---|
| TH 1599 | 60/177,999 | Toroidal Choke Inductor for Wireless Communication and Control | Jan. 24, 2000 |
| TH 1600 | 60/178,000 | Ferromagnetic Choke in Wellhead | Jan. 24, 2000 |
| TH 1602 | 60/178,001 | Controllable Gas-Lift Well and Valve | Jan. 24, 2000 |
| TH 1603 | 60/177,883 | Permanent, Downhole, Wireless, Two-Way Telemetry Backbone Using Redundant Repeater, Spread Spectrum Arrays | Jan. 24, 2000 |
| TH 1668 | 60/177,998 | Petroleum Well Having Downhole Sensors, Communication, and Power | Jan. 24, 2000 |
| TH 1669 | 60/177,997 | System and Method for Fluid Flow Optimization | Jan. 24, 2000 |
| TS 6185 | 60/181,322 | A Method and Apparatus for the Optimal Predistortion of an Electromagnetic Signal in a Downhole Communications System | Feb. 9, 2000 |
| TH 1599x | 60/186,376 | Toroidal Choke Inductor for Wireless Communication and Control | Mar. 2, 2000 |
| TH 1600x | 60/186,380 | Ferromagnetic Choke in Wellhead | Mar. 2, 2000 |
| TH 1601 | 60/186,505 | Reservoir Production Control from Intelligent Well Data | Mar. 2, 2000 |
| TH 1671 | 60/186,504 | Tracer Injection in a Production Well | Mar. 2, 2000 |
| TH 1672 | 60/186,379 | Oilwell Casing Electrical Power Pick-Off Points | Mar. 2, 2000 |
| TH 1673 | 60/186,394 | Controllable Production Well Packer | Mar. 2, 2000 |
| TH 1674 | 60/186,382 | Use of Downhole High Pressure Gas in a Gas Lift Well | Mar. 2, 2000 |
| TH 1675 | 60/186,503 | Wireless Smart Well Casing | Mar. 2, 2000 |
| TH 1677 | 60/186,527 | Method for Downhole Power Management Using Energization from Distributed Batteries or Capacitors with Reconfigurable Discharge | Mar. 2, 2000 |
| TH 1679 | 60/186,393 | Wireless Downhole Well Interval Inflow and Injection Control | Mar. 2, 2000 |
| TH 1681 | 60/186,394 | Focused Through-Casing Resistivity Measurement | Mar. 2, 2000 |
| TH 1704 | 60/186,531 | Downhole Rotary Hydraulic Pressure for Valve Actuation | Mar. 2, 2000 |
| TH 1705 | 60/186,377 | Wireless Downhole Measurement and Control For Optimizing Gas Lift Well and Field Performance | Mar. 2, 2000 |
| TH 1722 | 60/186,381 | Controlled Downhole Chemical Injection | Mar. 2, 2000 |
| TH 1723 | 60/186,378 | Wireless Power and Communications Cross-Bar Switch | Mar. 2, 2000 |

The current application shares some specification and figures with the following commonly owned and concurrently filed applications, all of which are hereby incorporated by reference:

COMMONLY OWNED AND CONCURRENTLY FILED U.S PATENT APPLICATIONS

| T&K # | Serial Number | Title | Filing Date |
|---|---|---|---|
| TH 1601US | 10/220,254 | Reservoir Production Control from Intelligent Well Data | Aug. 29, 2002 |
| TH 1672US | 10/220,402 | Oil Well Casing Electrical Power Pick-Off Points | Aug. 29, 2002 |
| TH 1673US | 10/220,252 | Controllable Production Well Packer | Aug. 29, 2002 |
| TH 1674US | 10/220,249 | Use of Downhole High Pressure Gas in a Gas-Lift Well | Aug. 29, 2002 |
| TH 1675US | 10/220,195 | Wireless Smart Well Casing | Aug. 29, 2002 |
| TH 1677US | 10/220,253 | Method for Downhole Power Management Using Energization from Distributed Batteries or Capacitors with Reconfigurable Discharge | Aug. 29, 2002 |
| TH 1679US | 10/220,453 | Wireless Downhole Well Interval Inflow and Injection Control | Aug. 29, 2002 |

-continued

| COMMONLY OWNED AND CONCURRENTLY FILED U.S PATENT APPLICATIONS | | | |
|---|---|---|---|
| T&K # | Serial Number | Title | Filing Date |
| TH 1704US | 10/220,326 | Downhole Rotary Hydraulic Pressure for Valve Actuation | Aug. 29, 2002 |
| TH 1705US | 10/220,455 | Wireless Downhole Measurement and Control For Optimizing Gas Lift Well and Field Performance | Aug. 29, 2002 |
| TH 1722US | 10/220,372 | Controlled Downhole Chemical Injection | Aug. 30, 2002 |
| TH 1723US | 10/220,652 | Wireless Power and Communications Cross-Bar Switch | Aug. 29, 2002 |

The current application shares some specification and figures with the following commonly owned and previously filed applications, all of which are hereby incorporated by reference:

| COMMONLY OWNED AND PREVIOUSLY FILED U.S PATENT APPLICATIONS | | | |
|---|---|---|---|
| T&K # | Serial Number | Title | Filing Date |
| TH 1599US | 09/769,047 | Choke Inductor for Wireless Communication and Control | Oct. 20, 2003 |
| TH 1600US | 09/769,048 | Induction Choke for Power Distribution in Piping Structure | Jan. 24, 2001 |
| TH 1602US | 09/768,705 | Controllable Gas-Lift Well and Valve | Jan. 24, 2001 |
| TH 1603US | 09/768,655 | Permanent Downhole, Wireless, Two-Way Telemetry Backbone Using Redundant Repeater | Jan. 24, 2001 |
| TH 1668US | 09/768,046 | Petroleum Well Having Downhole Sensors, Communication, and Power | Jan. 24, 2001 |
| TH 1669US | 09/768,656 | System and Method for Fluid Flow Optimization | Jan. 24, 2001 |
| TS 6185US | 09/779,935 | A Method and Apparatus for the Optimal Predistortion of an Electro Magnetic Signal in a Downhole Communications System | Feb. 8, 2001 |

The benefit of 35 U.S.C. § 120 is claimed for all of the above referenced commonly owned applications. The applications referenced in the tables above are referred to herein as the "Related Applications."

BACKGROUND OF THE INVENTION

1. Field of the Invention

The present invention relates to a petroleum well for producing petroleum products. In one aspect, the present invention relates to systems and methods for monitoring fluid flow during petroleum production by controllably injecting tracer materials into at least one fluid flow stream with at least one electrically controllable downhole tracer injection system of a petroleum well.

2. Description of Related Art

The controlled injection of materials into petroleum wells (i.e., oil and gas wells) is an established practice frequently used to increase recovery, or to analyze production conditions.

It is useful to distinguish between types of injection, depending on the quantities of materials that will be injected. Large volumes of injected materials are injected into formations to displace formation fluids towards producing wells. The most common example is water flooding.

In a less extreme case, materials are introduced downhole into a well to effect treatment within the well. Examples of these treatments include: (1) foaming agents to improve the efficiency of artificial lift; (2) paraffin solvents to prevent deposition of solids onto the tubing; and (3) surfactants to improve the flow characteristics of produced fluids. These types of treatment entail modification of the well fluids themselves. Smaller quantities are needed, yet these types of injection are typically supplied by additional tubing routed downhole from the surface.

Still other applications require even smaller quantities of materials to be injected, such as: (1) corrosion inhibitors to prevent or reduce corrosion of well equipment; (2) scale preventers to prevent or reduce scaling of well equipment; and (3) tracer materials to monitor the flow characteristics of various well sections. In these cases the quantities required are small enough that the materials may be supplied from a downhole reservoir, avoiding the need to run supply tubing downhole from the surface. However, the successful application of techniques requiring controlled injection from a downhole reservoir requires that means must be provided to power and communicate with the injection equipment downhole. In existing practice this requires the use of electrical cables running from the surface to the injection modules at depth in the well. Such cables are expensive and not completely reliable, and as a consequence are considered undesirable in current production practice.

The use of tracers to identify materials and track their flow is an established technique in other industries, and the development of the tracer materials and the detectors has proceeded to the point where the materials may be sensed in dilutions down to $10^{-10}$, and millions of individually identifiable taggants are available. A representative leading supplier of such materials and detection equipment is Isotag LLC of Houston, Tex.

The use of tracers to determine flow patterns has been applied in a wide variety of research fields, such as observing biological circulatory systems in animals and plants. It has also been offered as a commercial service in the oilfield, for instance as a means to analyze injection profiles. However the use of tracers for production in the oilfield is by exception, since existing methods require the insertion into the borehole of special equipment powered and controlled using cables or hydraulic lines from the surface to depth in the well.

All references cited herein are incorporated by reference to the maximum extent allowable by law. To the extent a reference may not be fully incorporated herein, it is incorporated by reference for background purposes, and indicative of the knowledge of one of ordinary skill in the art.

BRIEF SUMMARY OF THE INVENTION

The problems and needs outlined above are largely solved and met by the present invention. In accordance with one aspect of the present invention, a tracer injection system for use in a well, is provided. The tracer injection system comprises a current impedance device and a downhole electrically controllable tracer injection device. The current impedance device is generally configured for concentric positioning about a portion of a piping structure of the well such that when a time-varying electrical current is transmitted through and along the portion of the piping structure a voltage potential forms between one side of the current impedance device and another side of the current impedance device. The downhole electrically controllable tracer injection device is adapted to be electrically connected to the piping structure across the voltage potential formed by the current impedance device, adapted to be powered by the electrical current, and adapted to expel a tracer material into the well in response to an electrical signal.

In accordance with another aspect of the present invention, a petroleum well for producing petroleum products, is provided. The petroleum well comprises a piping structure, a source of time-varying current, an induction choke, an electrically controllable tracer injection device, and an electrical return. The piping structure comprises a first portion, a second portion, and an electrically conductive portion extending in and between the first and second portions. The first and second portions are distally spaced from each other along the piping structure. The source of time-varying current is electrically connected to the electrically conductive portion of the piping structure at the first portion. The induction choke is located about a portion of the electrically conductive portion of the piping structure at the second portion. The electrically controllable tracer injection device comprises two device terminals, and is located at the second portion. The electrical return electrically connects between the electrically conductive portion of the piping structure at the second portion and the current source. A first of the device terminals is electrically connected to the electrically conductive portion of the piping structure on a source-side of the induction choke. A second of the device terminals is electrically connected to the electrically conductive portion of the piping structure on an electrical-return-side of the induction choke and/or the electrical return.

In accordance with yet another aspect of the present invention, a well is provided that comprises a piping structure, a source of time-varying current, an induction choke, a sensor device, and an electrical return. The piping structure comprises a first portion, a second portion, and an electrically conductive portion extending in and between the first and second portions. The first and second portions are distally spaced from each other along the piping structure. The source of time-varying current is electrically connected to the electrically conductive portion of the piping structure at the first portion. The induction choke located about a portion of the electrically conductive portion of the piping structure at the second portion. The sensor device comprises two device terminals and a sensor. The sensor device is located at the second portion, and the sensor is adapted to detect a tracer material. The electrical return electrically connects between the electrically conductive portion of the piping structure at the second portion and the current source. A first of the device terminals is electrically connected to the electrically conductive portion of the piping structure on a source-side of the induction choke. A second of the device terminals is electrically connected to the electrically conductive portion of the piping structure on an electrical-return-side of the induction choke and/or the electrical return.

In accordance with still another aspect of the present invention, a petroleum well for producing petroleum products, is provided. The petroleum well comprises a well casing, a production tubing, a source of time-varying current, a downhole tracer injection device, and a downhole induction choke. The well casing extending within a wellbore of the well. The production tubing extending within the casing. The source of time-varying current located at the surface. The current source is electrically connected to, and adapted to output a time-varying current into, the tubing and/or the casing. The downhole tracer injection device comprises a communications and control module, a tracer material reservoir, and an electrically controllable tracer injector. The communications and control module is electrically connected to the tubing and/or the casing. The tracer injector is electrically connected to the communications and control module. The tracer material reservoir is in fluid communication with the tracer injector. The downhole induction choke is located about a portion of the tubing and/or the casing. The induction choke is adapted to route part of the electrical current through the communications and control module by creating a voltage potential between one side of the induction choke and another side of the induction choke, wherein the communications and control module is electrically connected across the voltage potential.

In accordance with a further aspect of the present invention, method of producing petroleum products from a petroleum well, is provided. The method comprises the steps of: (i) providing a piping structure extending within a wellbore of the well; (ii) providing a downhole tracer injection system for the well comprises an induction choke and an electrically controllable tracer injection device, the induction choke being located downhole about the piping structure such that when a time-varying electrical current is transmitted through the piping structure, a voltage potential forms between one side of the induction choke and another side of the induction choke, the electrically controllable tracer injection device being located downhole, the injection device being electrically connected to the piping structure across the voltage potential formed by the induction choke such that the injection device can be powered by the electrical current, and the injection device being adapted to expel a tracer material in response to an electrical signal; and (iii) controllably injecting the tracer material into a downhole flow stream within the well with the tracer injection device during production. The method may further comprise the steps of: (iv) providing a downhole sensor device within the well that is electrically connected to the piping structure and that can be powered by the electrical current; (v)

monitoring the flow stream at a location downstream of the tracer injection device; (vi) detecting the tracer material within the flow stream with the sensor device; and (vii) acting to alter the flow stream when this is desirable to meet treatment or recovery objectives.

In accordance with a further aspect of the present invention, method of injecting fluids into a formation with a well, is provided. The method comprises the steps of: (i) providing a piping structure extending within a wellbore of the well; (ii) providing a downhole sensor system for the well comprises an induction choke and a sensor device, the induction choke being located downhole about the piping structure such that when a time-varying electrical current is transmitted through the piping structure, a voltage potential forms between one side of the induction choke and another side of the induction choke, the sensor device being located downhole, the sensor device being electrically connected to the piping structure across the voltage potential formed by the induction choke such that the sensor device can be powered by the electrical current, and the sensor device comprises a sensor adapted to detect a tracer material; and (iii) detecting the tracer material within a flow stream of the well with the sensor device during fluid injection operation. The method may further comprise the steps of: (iv) providing a tracer injection device for said well at the surface; and (v) injecting said tracer material into said flow stream going into said well with said tracer injection device.

BRIEF DESCRIPTION OF THE DRAWINGS

Other objects and advantages of the invention will become apparent upon reading the following detailed description and upon referencing the accompanying drawings, in which.

DETAILED DESCRIPTION OF THE INVENTION

Figure 1:
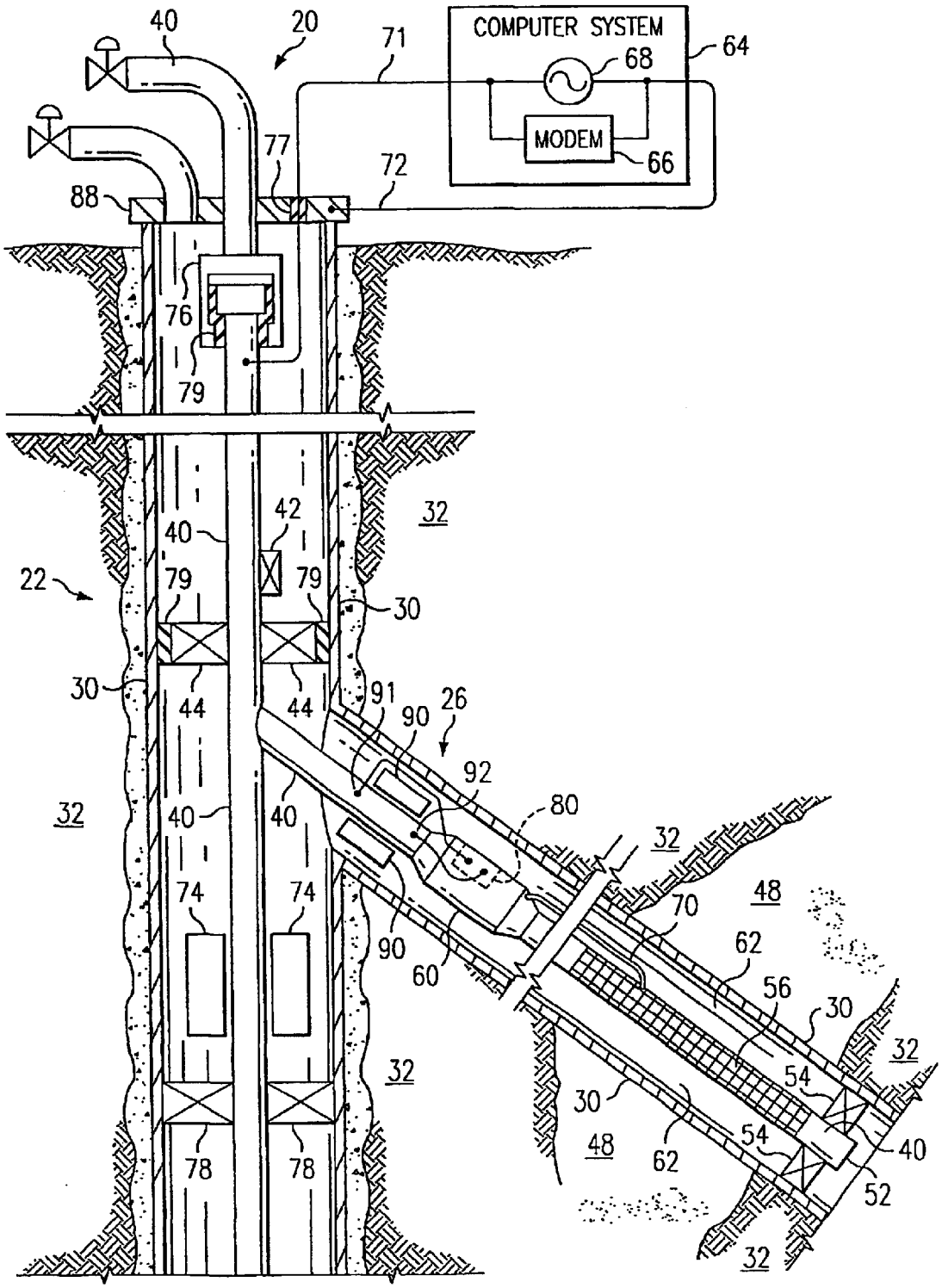
FIG. 1 is a schematic showing a petroleum production well in accordance with a preferred embodiment of the present invention.

Referring now to the drawings, wherein like reference numbers are used herein to designate like elements throughout the various views, preferred embodiments of the present invention are illustrated and further described. The figures are not necessarily drawn to scale, and in some instances the drawings have been exaggerated and/or simplified in places for illustrative purposes only. One of ordinary skill in the art will appreciate the many possible applications and variations of the present invention based on the following examples of possible embodiments of the present invention, as well as based on those embodiments illustrated and discussed in the Related Applications, which are incorporated by reference herein to the maximum extent allowed by law.

As used in the present application, a "piping structure" can be one single pipe, a tubing string, a well casing, a pumping rod, a series of interconnected pipes, rods, rails, trusses, lattices, supports, a branch or lateral extension of a well, a network of interconnected pipes, or other similar structures known to one of ordinary skill in the art. A preferred embodiment makes use of the invention in the context of a petroleum well where the piping structure comprises tubular, metallic, electrically-conductive pipe or tubing strings, but the invention is not so limited. For the present invention, at least a portion of the piping structure needs to be electrically conductive, such electrically conductive portion may be the entire piping structure (e.g., steel pipes, copper pipes) or a longitudinal extending electrically conductive portion combined with a longitudinally extending non-conductive portion. In other words, an electrically conductive piping structure is one that provides an electrical conducting path from a first portion where a power source is electrically connected to a second portion where a device and/or electrical return is electrically connected. The piping structure will typically be conventional round metal tubing, but the cross-section geometry of the piping structure, or any portion thereof, can vary in shape (e.g., round, rectangular, square, oval) and size (e.g., length, diameter, wall thickness) along any portion of the piping structure. Hence, a piping structure must have an electrically conductive portion extending from a first portion of the piping structure to a second portion of the piping structure, wherein the first portion is distally spaced from the second portion along the piping structure.

The terms "first portion" and "second portion" as used herein are each defined generally to call out a portion, section, or region of a piping structure that may or may not extend along the piping structure, that can be located at any chosen place along the piping structure, and that may or may not encompass the most proximate ends of the piping structure.

The term "modem" is used herein to generically refer to any communications device for transmitting and/or receiving electrical communication signals via an electrical conductor (e.g., metal). Hence, the term "modem" as used herein is not limited to the acronym for a modulator (device that converts a voice or data signal into a form that can be transmitted)/demodulator (a device that recovers an original signal after it has modulated a high frequency carrier). Also, the term "modem" as used herein is not limited to conventional computer modems that convert digital signals to analog signals and vice versa (e.g., to send digital data signals over the analog Public Switched Telephone Network). For example, if a sensor outputs measurements in an analog format, then such measurements may only need to be modulated (e.g., spread spectrum modulation) and transmitted—hence no analog/digital conversion needed. As another example, a relay/slave modem or communication device may only need to identify, filter, amplify, and/or retransmit a signal received.

The term "valve" as used herein generally refers to any device that functions to regulate the flow of a fluid. Examples of valves include, but are not limited to, bellows-type gas-lift valves and controllable gas-lift valves, each of which may be used to regulate the flow of lift gas into a tubing string of a well. The internal and/or external workings of valves can vary greatly, and in the present application, it is not intended to limit the valves described to any particular configuration, so long as the valve functions to regulate flow. Some of the various types of flow regulating mechanisms include, but are not limited to, ball valve configurations, needle valve configurations, gate valve configurations, and cage valve configurations. The methods of installation for valves discussed in the present application can vary widely.

The term "electrically controllable valve" as used herein generally refers to a "valve" (as just described) that can be opened, closed, adjusted, altered, or throttled continuously in response to an electrical control signal (e.g., signal from a surface computer or from a downhole electronic controller module). The mechanism that actually moves the valve position can comprise, but is not limited to: an electric motor; an electric servo; an electric solenoid; an electric switch; a hydraulic actuator controlled by at least one electrical servo, electrical motor, electrical switch, electric solenoid, or combinations thereof; a pneumatic actuator controlled by at least one electrical servo, electrical motor, electrical switch, electric solenoid, or combinations thereof; or a spring biased device in combination with at least one electrical servo, electrical motor, electrical switch, electric solenoid, or combinations thereof. An "electrically controllable valve" may or may not include a position feedback sensor for providing a feedback signal corresponding to the actual position of the valve.

The term "sensor" as used herein refers to any device that detects, determines, monitors, records, or otherwise senses the absolute value of or a change in a physical quantity. A sensor as described herein can be used to measure physical quantities including, but not limited to: temperature, pressure (both absolute and differential), flow rate, seismic data, acoustic data, pH level, salinity levels, valve positions, volume, or almost any other physical data. A sensor as described herein also can be used to detect the presence or concentration of a tracer material within a flow stream.

The phrase "at the surface" as used herein refers to a location that is above about fifty feet deep within the Earth. In other words, the phrase "at the surface" does not necessarily mean sitting on the ground at ground level, but is used more broadly herein to refer to a location that is often easily or conveniently accessible at a wellhead where people may be working. For example, "at the surface" can be on a table in a work shed that is located on the ground at the well platform, it can be on an ocean floor or a lake floor, it can be on a deep-sea oil rig platform, or it can be on the 100th floor of a building. Also, the term "surface" may be used herein as an adjective to designate a location of a component or region that is located "at the surface." For example, as used herein, a "surface" computer would be a computer located "at the surface."

The term "downhole" as used herein refers to a location or position below about fifty feet deep within the Earth. In other words, "downhole" is used broadly herein to refer to a location that is often not easily or conveniently accessible from a wellhead where people may be working. For example in a petroleum well, a "downhole" location is often at or proximate to a subsurface petroleum production zone, irrespective of whether the production zone is accessed vertically, horizontally, lateral, or any other angle therebetween. Also, the term "downhole" is used herein as an adjective describing the location of a component or region. For example, a "downhole" device in a well would be a device located "downhole," as opposed to being located "at the surface."

As used in the present application, "wireless" means the absence of a conventional, insulated wire conductor e.g. extending from a downhole device to the surface. Using the tubing and/or casing as a conductor is considered "wireless."

Similarly, in accordance with conventional terminology of oilfield practice, the descriptors "upper," "lower,"

"uphole," and "downhole" are relative and refer to distance along hole depth from the surface, which in deviated or horizontal wells may or may not accord with vertical elevation measured with respect to a survey datum.

FIG. 1 is a schematic showing a petroleum production well 20 in accordance with a preferred embodiment of the present invention. The well 20 has a vertical section 22 and a lateral section 26. The well has a well casing 30 extending within the wellbore and through a formation 32, and a production tubing 40 extends within the well casing for conveying fluids from downhole to the surface during production. Hence, the petroleum production well 20 shown in FIG. 1 is similar to existing practice in well construction, but with the incorporation of the present invention.

The vertical section 22 in this embodiment incorporates a gas-lift valve 42 and an upper packer 44 to provide artificial lift for fluids within the tubing 40. However, in alternative, other ways of providing artificial lift may be incorporated to form other possible embodiments (e.g., rod pumping). Also, the vertical portion 22 can further vary to form many other possible embodiments. For example in an enhanced form, the vertical portion 22 may incorporate one or more electrically controllable gas-lift valves, one or more additional induction chokes, and/or one or more controllable packers comprising electrically controllable packer valves, as further described in the Related Applications.

The lateral section 26 of the well 20 extends through a petroleum production zone 48 (e.g., oil zone) of the formation 32. The casing 30 in the lateral section 26 is perforated at the production zone 48 to allow fluids from the production zone 48 to flow into the casing. FIG. 1 shows only one lateral section 26, but there can be many lateral branches of the well 20. The well configuration typically depends, at least in part, on the layout of the production zones for a given formation.

Part of the tubing 40 extends into the lateral section 26 and terminates with a closed end 52 past the production zone 48. The position of the tubing end 52 within the casing 30 is maintained by a lateral packer 54, which is a conventional packer. The tubing 40 has a perforated section 56 at the production zone 48 for fluid intake from the production zone 48. In other embodiments (not shown), the tubing 40 may continue beyond the production zone 48 (e.g., to other production zones), or the tubing 40 may terminate with an open end for fluid intake.

Figure 3:
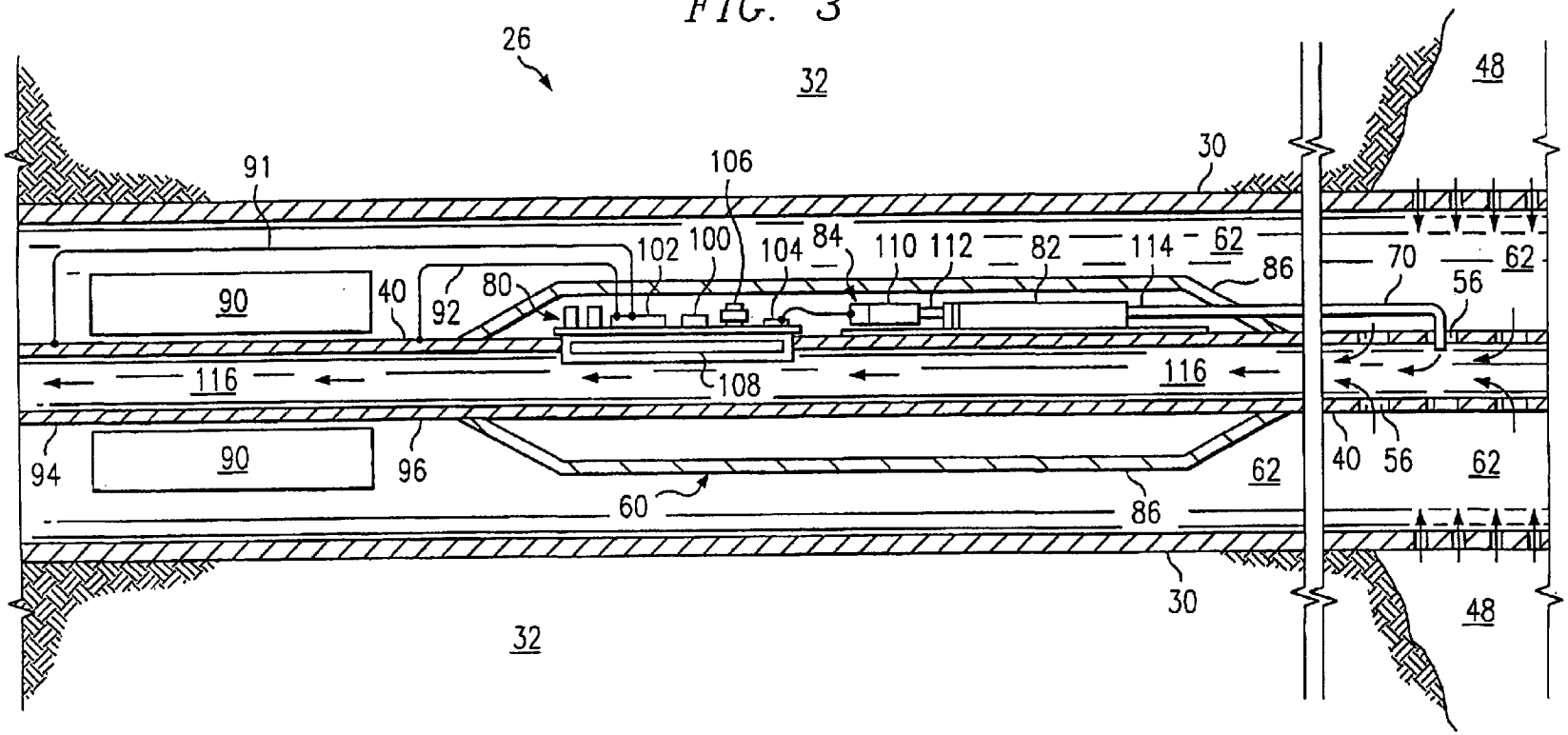
FIG. 3 is an enlarged view of a downhole portion of the well in FIG. 1.

An electrically controllable downhole tracer injection device 60 is connected inline on the tubing 40 within the lateral section 26 and forms part of the production tubing assembly. The injection device is located upstream of the production zone 48 near the vertical section for ease of placement. However, in other embodiments, the injection device 60 may be located further within a lateral section. An advantage of placing the injection device 60 proximate to the tubing intake 56 at the production zone 48 is that it a desirable location for injecting a tracer material. But when the injection device is remotely located relative to the tubing intake 56, as shown in FIG. 1, a tracer material can be injected into the tubing intake 56 at the production zone 48 using a nozzle extension tube 70. The nozzle extension tube 70 thus provides a way to inject a tracer material into a flow stream at a location remote from the injection device 60. Expelling a tracer material at a location remote from (e.g., up stream of) the injection device 60, via the nozzle extension tube 70, allows for a sensor adapted to detect the tracer material to be located at or within the injection device 60. (Such a sensor is 108 as shown in FIG. 3). In other possible embodiments, the injection device 60 may be adapted to controllably inject a tracer material at a location outside of the tubing 40 (e.g., directly into the producing zone 48, or into an annular space 62 within the casing 30). Therefore, an electrically controllable downhole tracer injection device 60 may be placed in any downhole location within a well where it is needed.

An electrical circuit is formed using various components of the well 20. Power for the electrical components of the injection device 60 is provided from the surface using the tubing 40 and casing 30 as electrical conductors. Hence, in a preferred embodiment, the tubing 40 acts as a piping structure and the casing 30 acts as an electrical return to form an electrical circuit in the well 20. Also, the tubing 40 and casing 30 are used as electrical conductors for communication signals between the surface (e.g., a surface computer system 64) and the downhole electrical components within the electrically controllable downhole tracer injection device 60.

In FIG. 1, a surface computer system 64 comprises a master modem 66 and a source of time-varying current 68. But, as will be clear to one of ordinary skill in the art, the surface equipment can vary. A first computer terminal 71 of the surface computer system 64 is electrically connected to the tubing 40 at the surface, and imparts time-varying electrical current into the tubing 40 when power to and/or communications with the downhole devices is needed. The current source 68 provides the electrical current, which carries power and communication signals downhole. The time-varying electrical current is preferably alternating current (AC), but it can also be a varying direct current (DC). The communication signals can be generated by the master modem 66 and embedded within the current produced by the source 68. Preferably, the communication signal is a spread spectrum signal, but other forms of modulation or predistortion can be used in alternative.

A first induction choke 74 is located about the tubing in the vertical section 22 below the location where the lateral section 26 extends from the vertical section. A second induction choke 90 is located about the tubing 40 within the lateral section 26 proximate to the injection device 60. The induction chokes 74, 90 comprise a ferromagnetic material and are unpowered. Because the chokes 74, 90 are located about the tubing 40, each choke acts as a large inductor to AC in the well circuit formed by the tubing 40 and casing 30. As described in further detail in the Related Applications, the chokes 74, 90 function based on their size (mass), geometry, and magnetic properties.

Figure 2A:
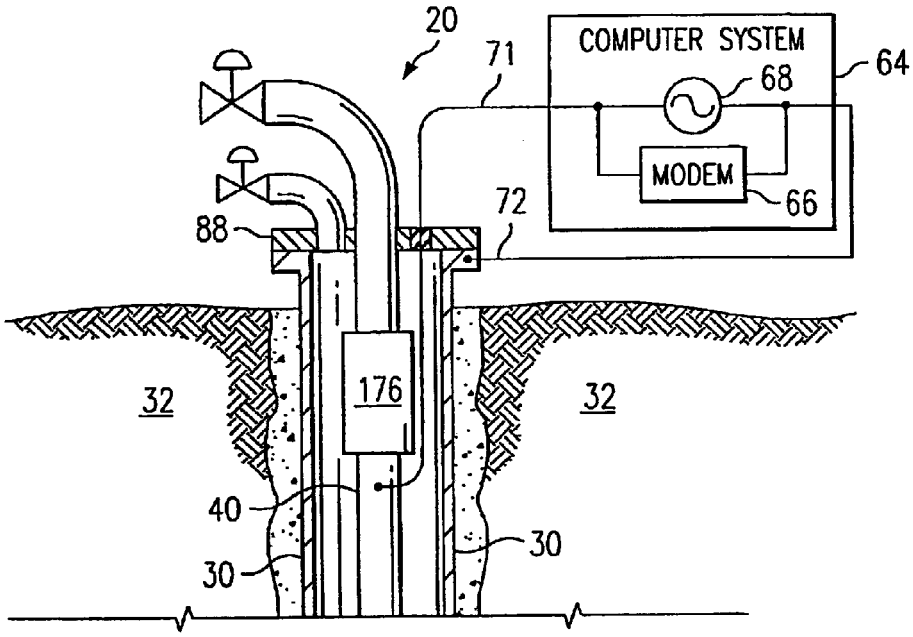
FIG. 2A is schematic of an upper portion of a petroleum well in accordance with another preferred embodiment of the present invention.
Figure 2B:
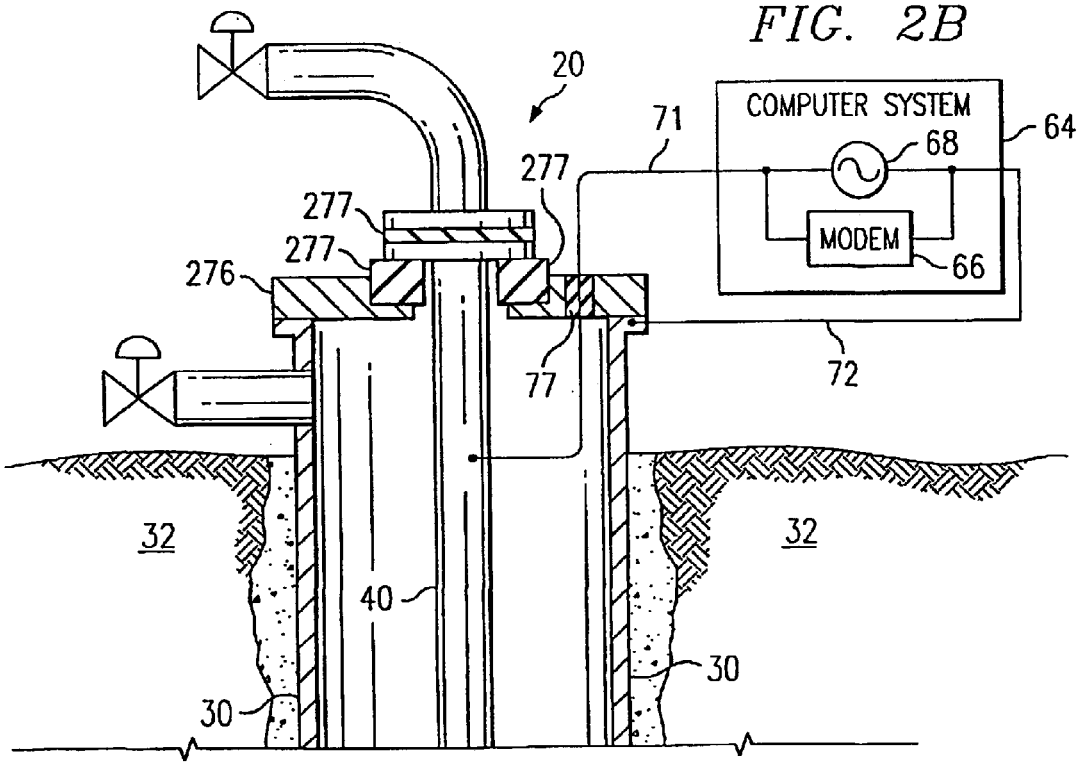
FIG. 2B is schematic of an upper portion of a petroleum well in accordance with yet another preferred embodiment of the present invention.

An insulated tubing joint 76 is incorporated at the wellhead to electrically insulate the tubing 40 from casing 30. The first computer terminal 71 from the current source 68 passes through an insulated seal 77 at the hanger 88 and electrically connects to the tubing 40 below the insulated tubing joint 76. A second computer terminal 72 of the surface computer system 64 is electrically connected to the casing 30 at the surface. Thus, the insulators 79 of the tubing joint 76 prevent a short between the tubing 40 and casing 30 at the surface. In alternative to (or in addition to) the insulated tubing joint 76, a third induction choke 176 (see FIG. 2A) can be placed about the tubing 40 above the electrical connection location for the first computer terminal 71 to the tubing, and/or the hanger 88 may be an insulated hanger 276 (see FIG. 2B) having insulators 277 to electrically insulate the tubing 40 from the casing 30.

The lateral packer 54 at the tubing end 52 within the lateral section 26 provides an electrical connection between the tubing 40 and the casing 30 downhole beyond the second choke 90. A lower packer 78 in the vertical section 22, which is also a conventional packer, provides an electrical connection between the tubing 40 and the casing 30 downhole below the first induction choke 74. The upper packer 44 of the vertical section 22 has an electrical insulator 79 to prevent an electrical short between the tubing 40 and the casing 30 at the upper packer. Also, various centralizers (not shown) having electrical insulators to prevent shorts between the tubing 40 and casing 30 can be incorporated as needed throughout the well 20. Such electrical insulation of the upper packer 44 or a centralizer may be achieved in various ways apparent to one of ordinary skill in the art. The upper and lower packers 44, 78 provide hydraulic isolation between the main wellbore of the vertical section 22 and the lateral wellbore of the lateral section 26.

FIG. 3 is an enlarged view showing a portion of the lateral section 26 of FIG. 1 with the electrically controllable downhole tracer injection device 60 therein. The injection device 60 comprises a communications and control module 80, a tracer material reservoir 82, an electrically controllable tracer injector 84, and a sensor 108. Preferably, the components of an electrically controllable downhole tracer injection device 60 are all contained in a single, sealed tubing pod 86 together as one module for ease of handling and installation, as well as to protect the components from the surrounding environment. However, in other embodiments of the present invention, the components of an electrically controllable downhole tracer injection device 60 can be separate (i.e., no tubing pod 86) or combined in other combinations. A first device terminal 91 of the injection device 60 electrically connects between the tubing 40 on a source-side 94 of the second induction choke 90 and the communications and control module 80. A second device terminal 92 of the injection device 60 electrically connects between the tubing 40 on an electrical-return-side 96 of the second induction choke 90 and the communications and control module 80. Although the lateral packer 54 provides an electrical connection between the tubing 40 on the electrical-return-side 96 of the second induction 90 and the casing 30, the electrical connection between the tubing 40 and the well casing 30 also can be accomplished in numerous ways, some of which can be seen in the Related Applications, including (but not limited to): another packer (conventional or controllable); a conductive centralizer; conductive fluid in the annulus between the tubing and the well casing; or any combination thereof.

Figure 4:
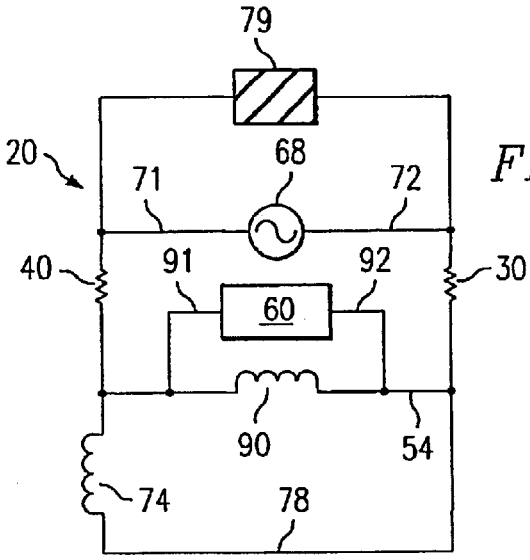
FIG. 4 is a simplified electrical schematic of the electrical circuit formed by the well of FIG. 1.

FIG. 4 is a simplified electrical schematic illustrating the electrical circuit formed in the well 20 of FIG. 1. In operation, and referring to both FIG. 1 and FIG. 4, power and/or communications are imparted into the tubing 40 at the surface via the first computer terminal 71 below the insulated tubing joint 76. Time-varying current is hindered from flowing from the tubing 40 to the casing 30 via the hanger 88 due to the insulators 79 of the insulated tubing joint 76. However, the time-varying current flows freely along the tubing 40 until the induction chokes 74, 90 are encountered. The first induction choke 74 provides a large inductance that impedes most of the current from flowing through the tubing 40 at the first induction choke. Similarly, the second induction choke 90 provides a large inductance that impedes most of the current from flowing through the tubing 40 at the second induction choke. A voltage potential forms between the tubing 40 and casing 30 due to the induction chokes 74, 90. The voltage potential also forms between the tubing 40 on the source-side 94 of the second induction choke 90 and the tubing 40 on the electrical-return-side 96 of the second induction choke 90. Because the communications and control module 80 is electrically connected across the voltage potential, most of the current imparted into the tubing 40 that is not lost along the way is routed through the communications and control module 80, which distributes and/or decodes the power and/or communications for the injection device 60. After passing through the injection device 60, the current returns to the surface computer system 64 via the lateral packer 54 and the casing 30. When the current is AC, the flow of the current just described will also be reversed through the well 20 along the same path.

Other alternative ways to develop an electrical circuit using a piping structure of a well and at least one induction choke are described in the Related Applications, many of which can be applied in conjunction with the present invention to provide power and/or communications to the electrically powered downhole devices and to form other embodiments of the present invention.

Referring to FIG. 3 again, the communications and control module 80 comprises an individually addressable modem 100, power conditioning circuits 102, a control interface 104, and a sensors interface 106. Because the modem 100 of the downhole injection device 60 is individually addressable, more than one downhole device may be installed and operated independently of others.

In FIG. 3, the electrically controllable tracer injector 84 is electrically connected to the communications and control module 80, and thus obtains power and/or communications from the surface computer system 64 via the communications and control module 80. The tracer material reservoir 82 is in fluid communication with the tracer injector 84. The tracer material reservoir 82 is a self-contained reservoir that stores and supplies tracer materials for injecting into the flow stream by the tracer injector 84. The tracer material reservoir 82 of FIG. 3, is not supplied by a tracer material supply tubing (not shown) extending from the surface, but in other embodiments it may be. Hence, the size of the tracer material reservoir 82 may vary, depending on the volume of tracer materials needed for the injecting into the well 20. The tracer injector 84 of a preferred embodiment comprises an electric motor 110, a screw mechanism 112, and a nozzle 114. The electric motor 110 is electrically connected to and receives motion command signals from the communications and control module 80. The nozzle extension tube 70 extends from the nozzle 114 into an interior 116 of the tubing at the tubing intake 56 (farther upstream), and provides a fluid passageway from the tracer material reservoir 82 to the tubing interior 116. The screw mechanism 112 is mechanically coupled to the electric motor 110. The screw mechanism 112 is used to drive tracer materials out of the reservoir 82 and into the tubing interior 116, via the nozzle 114 and via the nozzle extension tube 70, in response to a rotational motion of the electric motor 110. Preferably the electric motor 110 is a stepper motor, and thus provides tracer material injection in incremental amounts.

In operation, the fluid stream from the production zone 48 passes around the tracer injection device 60 as it flows through the tubing 40 to the surface. Commands from the surface computer system 64 are transmitted downhole and received by the modem 100 of the communications and control module 80. Within the injection device 60 the commands are decoded and passed from the modem 100 to the control interface 104. The control interface 104 then commands the electric motor 110 to operate and inject the specified quantity of tracer materials from the reservoir 82 into the fluid flow stream in the tubing 40. Hence, the tracer injection device 60 controllably injects a tracer material into the fluid stream flowing within the tubing 40, as needed or as desired, in response to commands from the surface computer system 64 via the communications and control module 80.

The tracer injection device 60 of FIG. 3 also comprises sensors 108. At least one of the sensors 108 is adapted to detect the presence and/or concentration of a tracer material within the flow stream passing through the tubing 40. The sensors 108 are electrically connected to the communications and control module 80 via the sensor interface 106. The tracer injection device 60 may also further comprise sensors to make other measurements, such as flow rate, temperature, or pressure. The data from the sensors 108 are encoded within the communications and control module 80 and can be transmitted to the surface computer system 64 by the modem 100. Thus during operation, when tracer material is injected into the tubing interior 116 upstream by the tracer injector 84 (via the nozzle extension tube 70), the sensors 108 detect the tracer as it passes within the flow stream. By measuring the arrival time (time from injection to detection) and/or the concentration of tracer detected, the characteristics of the flow stream can be determined, as further detailed below herein.

As will be apparent to one of ordinary skill in the art, the mechanical and electrical arrangement and configuration of the components within the electrically controllable tracer injection device 60 can vary while still performing the same function—providing electrically controllable tracer injection downhole. For example, the contents of a communications and control module 80 may be as simple as a wire connector terminal for distributing electrical connections from the tubing 40, or it may be very complex comprising (but not limited to) a modem, a rechargeable battery, a power transformer, a microprocessor, a memory storage device, a data acquisition card, and a motion control card.

FIGS. 5A–5D illustrate some possible variations of the tracer material reservoir 82 and tracer injector 84 that may be incorporated into the present invention to form other possible embodiments. In FIGS. 5A–5D), a nozzle extension tube 70 is not incorporated. Thus, the tracer injection devices show in FIGS. 5A–5D are adapted for being located at the location where the tracer injection is desired. However, a nozzle extension tube also can be incorporated into any of the embodiments shown in FIGS. 5A–5D.

Figure 5A:
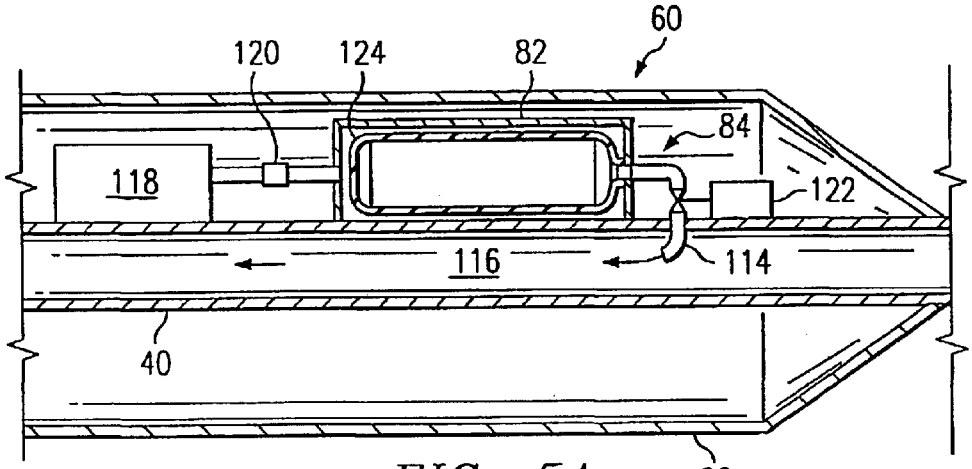
FIGS. 5A–5D are schematics of various tracer injector and tracer material reservoir embodiments for a downhole electrically controllable tracer injection device in accordance with the present invention.

In FIG. 5A, the tracer injector 84 comprises a pressurized gas reservoir 118, a pressure regulator 120, an electrically controllable valve 122, and a nozzle 114. The pressurized gas reservoir 118 is fluidly connected to the reservoir 82 via the pressure regulator 120, and thus supplies a generally constant gas pressure to the reservoir. The tracer material reservoir 82 has a bladder 124 therein that contains the tracer materials. The pressure regulator 120 regulates the passage of pressurized gas supplied from the pressurized gas reservoir 118 into the reservoir 82 but outside of the bladder 124. However, the pressure regulator 120 may be substituted with an electrically controllable valve. The pressurized gas exerts pressure on the bladder 124 and thus on the tracer materials therein. The electrically controllable valve 122 regulates and controls the passage of the tracer materials through the nozzle 114 and into the tubing interior 116. Because the tracer materials inside the bladder 124 are pressurized by the gas from the pressurized gas reservoir 118, the tracer materials are forced out of the nozzle 114 when the electrically controllable valve 122 is opened.

Figure 5B:
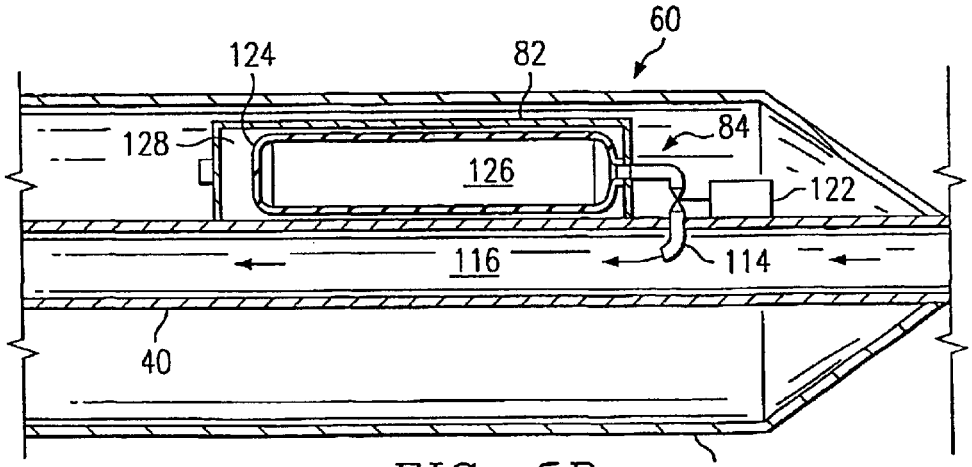

In FIG. 5B, the tracer material reservoir 82 is divided into two volumes 126, 128 by a bladder 124, which acts a separator between the two volumes 126, 128. A first volume 126 within the bladder 124 contains the tracer material, and a second volume 128 within the tracer material reservoir 82 but outside of the bladder contains a pressurized gas. Hence, the reservoir 82 is precharged and the pressurized gas exerts pressure on the tracer materials within the bladder 124. The tracer injector 84 comprises an electrically controllable valve 122 and a nozzle 114. The electrically controllable valve 122 is electrically connected to and controlled by the communications and control module 80. The electrically controllable valve 122 regulates and controls the passage of the tracer materials through the nozzle 114 and into the tubing interior 116. The tracer materials are forced out of the nozzle 114 due to the gas pressure when the electrically controllable valve 122 is opened.

Figure 5C:
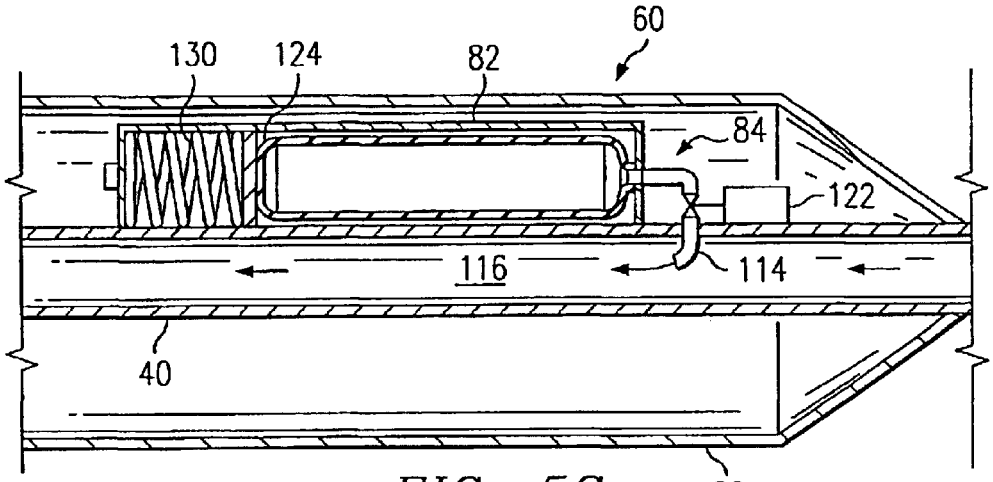

The embodiment shown in FIG. 5C is similar that of FIG. 5B, but the pressure on the bladder 124 is provided by a spring member 130. Also in FIG. 5C, the bladder may not be needed if there is movable seal (e.g., sealed piston) between the spring member 130 and the tracer materials within the reservoir 82. One of ordinary skill in the art will see that there can be many variations on the mechanical design of the tracer injector 84 and on the use of a spring member to provide pressure on the tracer materials.

Figure 5D:
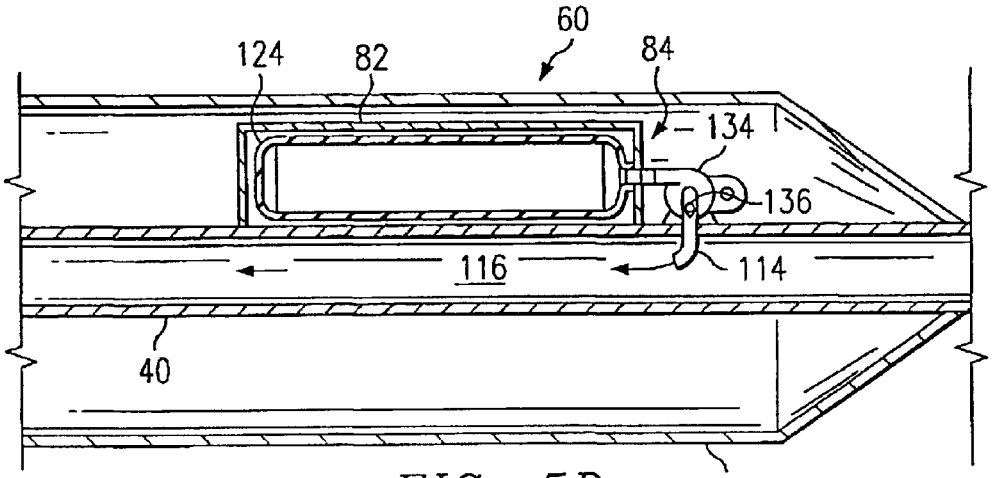

In FIG. 5D, the tracer material reservoir 82 has a bladder 124 containing a tracer material. The tracer injector 84 comprises a pump 134, a one-way valve 136, a nozzle 114, and an electric motor 110. The pump 134 is driven by the electric motor 110, which is electrically connected to and controlled by the communications and control module 80. The one-way valve 136 prevents backflow into the pump 134 and bladder 124. The pump 134 drives tracer materials out of the bladder 124, through the one-way valve 136, out of the nozzle 114, and into the tubing interior 116. Hence, the use of the tracer injector 84 of FIG. 5D may be advantageous in a case where the tracer material reservoir 82 is arbitrarily shaped to maximize the volume of tracer materials held therein for a given configuration because the reservoir configuration is not dependent on tracer injector 84 configuration implemented.

Thus, as the examples in FIGS. 5A–5D illustrate, there are many possible variations for the tracer material reservoir 82 and tracer injector 84. One of ordinary skill in the art will see that there can be many more variations for performing the functions of storing tracer materials downhole in combination with controllably injecting the tracer materials into the tubing interior 116 in response to an electrical signal. Variations (not shown) on the tracer injector 84 may further include (but are not limited to): a venturi tube at the nozzle; pressure on the bladder provided by a turbo device that extracts rotational energy from the fluid flow within the tubing; extracting pressure from other regions of the formation routed via a tubing; any possible combination of the parts of FIGS. 5A–5D; or any combination thereof.

The tracer injection device 60 may not inject tracer materials into the tubing interior 116. In other words, a tracer injection device may be adapted to controllably inject a tracer materials into the formation 32, into the casing 30, or directly into the production zone 48. Also, a single tracer injection device 60 may be adapted to expel multiple tracer materials (i.e., different tracer identifiers or signatures), such as by having multiple tracer material reservoirs 82 and/or multiple tracer injectors 84. A single tracer injection device 60 may be adapted to inject tracer materials into a well at numerous locations, for example, by having multiple nozzle extension tubes 70 extending to multiple locations.

The tracer injection device 60 may further comprise other components to form other possible embodiments of the present invention, including (but not limited to): other sensors, a modem, a microprocessor, a logic circuit, an electrically controllable tubing valve, multiple tracer material reservoirs (which may contain different tracers), multiple tracer injectors (which may be used to expel multiple tracer materials to multiple locations), or any combination thereof The tracer material injected may be a solid, liquid, gas, or mixtures thereof. The tracer material injected may be a single component, multiple components, or a complex formulation. Furthermore, there can be multiple controllable tracer injection devices for one or more lateral sections, each of which may be independently addressable, addressable in groups, or uniformly addressable from the surface computer system 64. In alternative to being controlled by the surface computer system 64, the downhole electrically controllable injection device 60 can be controlled by electronics therein or by another downhole device. Likewise, the downhole electrically controllable injection device 60 may control and/or communicate with other downhole devices. In an enhanced form of an electrically controllable tracer injection device 60, it comprises at least one additional sensor, each adapted to measure a physical quality such as (but not limited to): absolute pressure, differential pressure, fluid density, fluid viscosity, acoustic transmission or reflection properties, temperature, or chemical make-up. Also, a tracer injection device 60 may not contain any sensors (i.e., no sensor 108), and the sensor 108 for detecting a tracer material may be separate and remotely located (e.g., downstream, or at the surface) relative to the tracer injection device 60.

Figure 6:
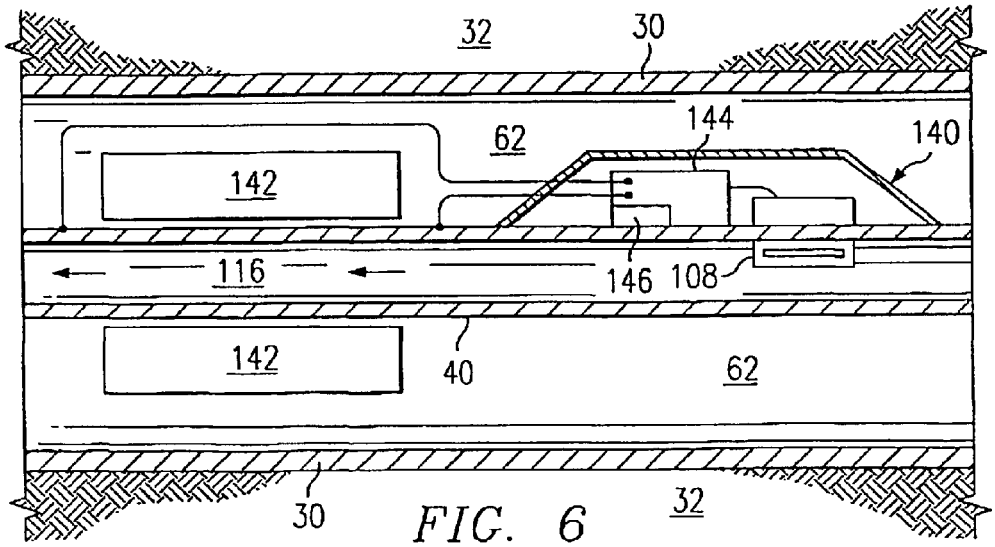
FIG. 6 is a schematic of a sensor device in a petroleum well in accordance with the present invention.

FIG. 6 illustrates an example of a separate, downhole sensor device 140 having its own corresponding induction choke 142 located proximate thereto for routing power and/or communications for the sensor device. The sensor device 140 comprises a sensor 108, a communications and control module 144 and a modem 146. Thus, data acquired by the sensor device 140 can be transmitted to a surface computer system or another downhole device using the tubing 40 and/or casing 30 as an electrical conductor.

In still another method of operation, the tracers may be generated downhole by the use of electrical currents, thereby obviating the need for a downhole chemical reservoir. This method offers the opportunity of an ongoing supply of tracer throughout the well life. For example, changes in pH of a natural brine can be effected by an electrolytic cell which decomposes the salts into chlorine gas and the metal hydroxide. Typically, sodium chloride is decomposed into chlorine gas and the metal hydroxide. A pH sensor may be used to detect such a pulse of high pH water that is generated in line or is collected and released as a slug. Another potentially useful electrically driven chemical reaction is the generation of ozone such as is used in devices for control of biological activity in swimming pools and water supply systems. In another application, a solid material may be placed in the well and made to enter into the well fluid stream by a controlled dissolution that is achieved by a controlled pulse of electrical energy. The dissolved material is preferably unique to the fluid environment of the well, thereby allowing detection at low concentrations. An example of such a solid material is a metallic zinc element. Commercially available analytical devices offer detection of many other compounds that can be electrically generated by those skilled in the art.

Upon review of the Related Applications, one of ordinary skill in the art will see that there can also be other electrically controllable downhole devices, as well as numerous induction chokes, further included in a well to form other possible embodiments of the present invention. Such other electrically controllable downhole devices include (but are not limited to): one or more controllable packers having electrically controllable packer valves, one or more electrically controllable gas-lift valves; one or more modems, one or more sensors; a microprocessor; a logic circuit; one or more electrically controllable tubing valves to control flow from various lateral branches; and other electronic components as needed.

Figure 7A:
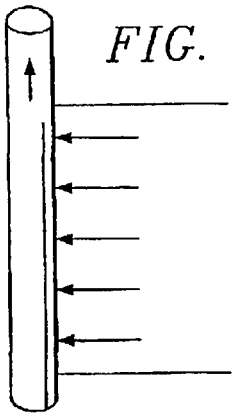
FIGS. 7A–7E are schematics of uniform inflow and injection profiles for various well configurations.
Figure 7B:
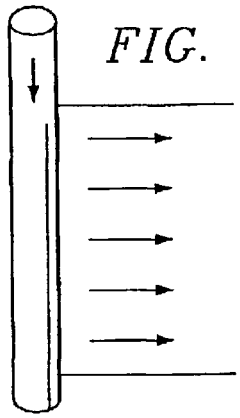

In use, a number of applications of the present invention arise, both in conventional wells and in complex future designs. For example, in vertical wells completed over long intervals, the inflow profiles of production wells are of interest in order to correct uneven inflow and thereby allow uniform depletion of the entire formation. Similarly, flooding operations in long interval completions depend upon attainment of uniform injection profiles in order to sweep out the whole zone. FIGS. 7A and 7B schematically illustrate uniform inflow and uniform injection profiles, respectively, for a vertical well.

Figure 7D:
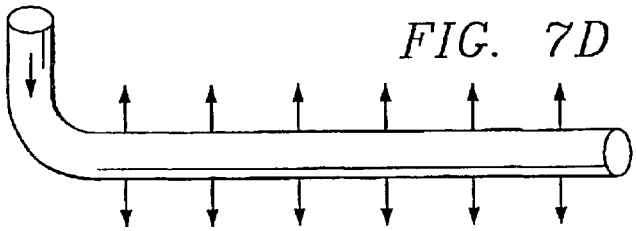
Figure 7C:
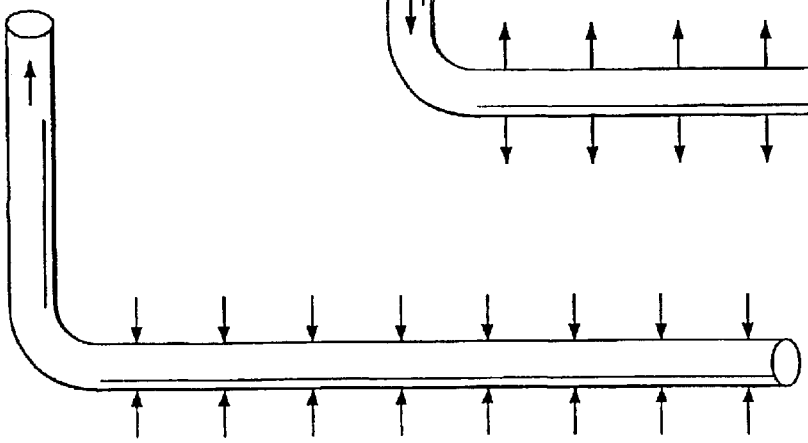

In wells with long horizontal completions, the maintenance of uniform profiles is less dependent on differences in permeabilities of geological layers as it is on the pressure gradients along the wells. These pressure gradients tend to favor high production rates near the well heel (i.e., the horizontal section nearest the vertical part of the well.) FIGS. 7C and 7D schematically illustrate uniform inflow and injection profiles, respectfully, for a long horizontal completion.

Figure 7E:
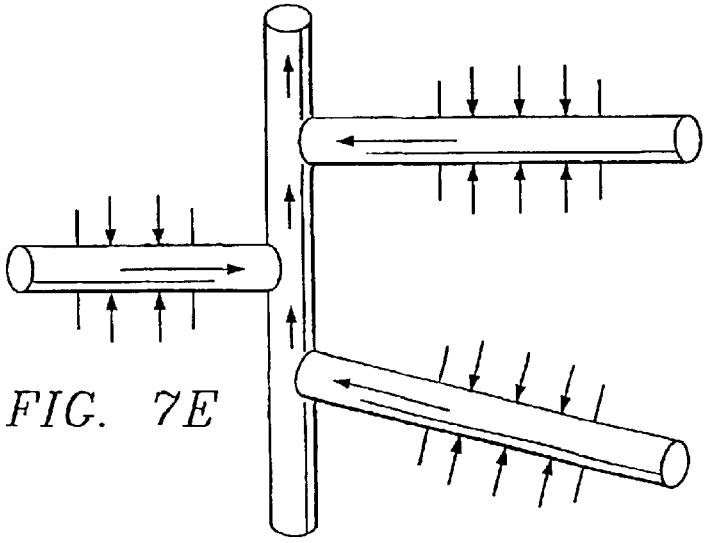

Another application is the use of tracers to differentiate production in wells with multiple lateral branches. In these wells it is important to understand which lateral is producing excessive water or which lateral is already depleted. FIG. 7E schematically illustrates a uniform inflow profile for multiple laterals. Hence, FIGS. 7A–7E illustrate the desirable flow profiles for just a few of the many possible well configurations, which are highly dependent on the natural layout of production zones in a given formation.

The movement of fluids in a subsurface well can be monitored by injecting tracers at various positions and observing the time of arrival and the dilution from fluids that enter the well downstream of the tracer injection point. As described above, the tracers are injected into a flow stream from a storage reservoir 82 within an injection device 60. But in alternative, a tracer may be generated within the injection device 60 by electrical methods.

The movement of a slug of tracer injected into a well stream is dependent on the degree of mixing during its transport along the well. In the case of simple flow in a pipe, the velocity profile varies with radial position, so that fluids move somewhat faster at the center of the pipe than at the wall. If flow is in the laminar region (that is, at low rates) the shape of the velocity profile is parabolic, and for the case of no-slip at the wall, a tracer would be scattered over the length of the flow. In practice, because pipe walls are rough and flow is fast, turbulent flow usually occurs. The turbulence mixes the fluids so that tracers are more uniformly transported and generally reflect the average velocity of flow in the pipe.

In production or injection wells completed with perforated or screened liners, inflow of fluids occurs through the pipe wall into the flow stream along the well. In this case, flow of a fluid that enters the well at the wall at various positions along the open interval is more complex. Examples given below apply to flow in either vertical or horizontal wells, however, a vertical well is used to demonstrate a laminar flow case in which inflow occurs along an open interval.

Assuming flow is laminar and no mixing occurs across flow streamlines, the fluid entering the bottom of the open interval initially fills the entire cross-section of the hole. Further uphole, additional inflow of fluids constricts the initial fluid that entered at the bottom and drives it radially inward. At the top of the open interval the last fluid that entered will be in the radial region near the wall and the initial fluid that entered at the bottom will be at the center of the well. Thus, tracer sensors should be placed such that they intercept the tracers in the passing stream. The use of a turbulator (not shown) immediately upstream of the sensor to mix the tracer stream into the bulk flow stream may be advantageous for this purpose.

Referring again to FIG. 7A, which illustrates the flow pattern for a fluid flowing at a uniform rate into a circular pipe, this flow pattern may be constructed with the following model:

Assumptions:

1) Uniform inflow of fluids into the well; and

2) Uniform velocity profile within the well.

This assumption is somewhat contrary to the expectation of parabolic velocity profiles for flow in a pipe with no-slip at the wall. However, in this case in which fluids are entering at the wall, the flow more closely approaches plug flow.

Definitions:

q=inflow rate/unit length of interval [barrels/day/ft]

L=height above bottom of open interval [ft]

$L_i$=fluid (tracer) inflow point above the bottom of open interval [ft]

$L_o$=total height of open interval [ft]

f=fraction of well area occupied by flow from the interval from 0 to L v=velocity of flow at height L [ft/day]

$r_o$=radius of well [ft]

r=radius of flow of fluids in well that entered well below L [ft]

Now consider fluids entering the well at some height, $L_i$, above the bottom of the well. At heights above this (L equal to or greater than $L_i$) the fraction of the cross-sectional well area occupied by the fluids which entered below $L_i$ is:

$$f=qL_i/qL=v\pi r^2/v\pi r_o^2 \quad (1)$$

Therefore, $$L=L_i(r_o/r)^2 \quad (2)$$

Figure 8:
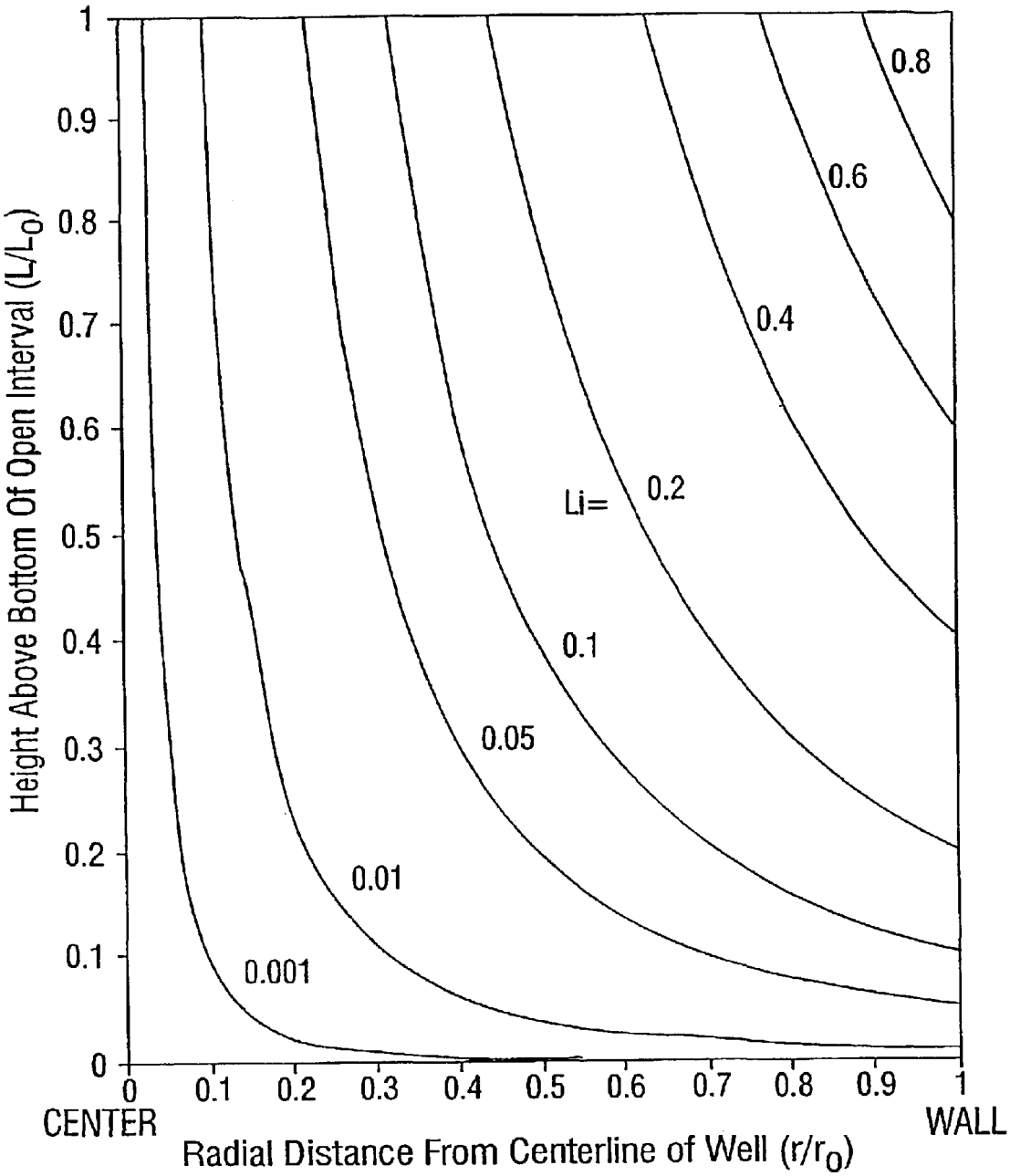
FIG. 8 is a plot illustrating fluid flow lines in a circular pipe with laminar flow in the case where fluids enter the pipe uniformly at its wall along the length of the pipe.

The plot in FIG. 8 shows the streamlines of flow in a well when fluids enter the well uniformly with depth. When flow is turbulent, as is the case in most wells, the streamlines are mixed. Under these conditions, the FIG. 8 plot represents the fraction of flow at a given depth (rather than the radial position) that is made up of fluids that entered the well below that depth.

To derive information on fluid movement in wells it is necessary to understand the time of arrival and the concentration of tracers that may be injected at various positions in the flowing stream. Use of the present invention provides ways to controllably inject a tracer material at virtually any downhole location and/or to detect the presence of or concentration of the tracer material with in the flow stream at virtually any downhole location. FIGS. 9A–9J provide just of few examples of the many possible placements of tracer injection devices 60 (which may or may not include a sensor 108) and/or sensor devices 140 in a production or injection well. Again, the desirable configuration of a well is typically dependent on the layout of production zones 48 in a formation 32. The downhole tracer injection devices 60 and downhole sensor devices 140 may or may not be permanently installed. Permanent downhole devices are preferred due to the expense and time required to add, remove, modify, replenish, or replace a downhole device. The present invention makes it possible to install downhole devices permanently because, among other things, the present invention provides innovative ways to provide power and/or communications to such permanent downhole devices.

Figure 9A:
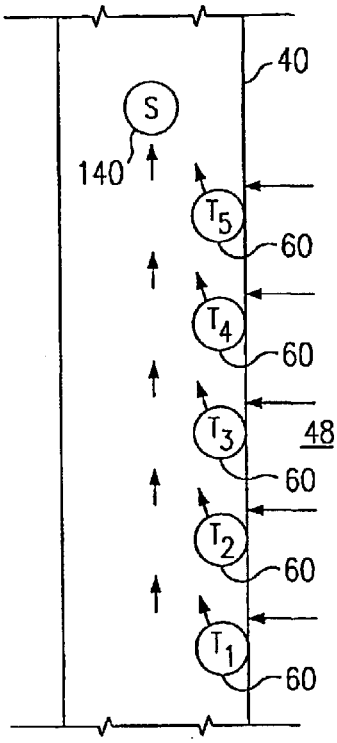
FIGS. 9A–9J are simplified schematics illustrating example various configurations for tracer injection device and sensor device placement within a variety of well configurations.

FIG. 9A is a simplified schematic illustrating a possible configuration of the present invention in a vertical production well. In FIG. 9A, there are five downhole tracer injection devices ($T_1$–$T_5$) 60 located at various places along the depth of the vertical well at the production zone 48 for injecting tracer materials within the flow stream at various depths. A downhole sensor device 140 is located upstream of the tracer injection devices ($T_1$–$T_5$) 60 for detecting tracer materials in the flow stream as they pass. The sensor device 140 may comprise multiple sensors 108, each being adapted to detect a different tracer material signature corresponding to the different tracer injection devices ($T_1$–$T_5$) 60. Alternatively the same tracer may be used in all injector devices and the origin of the tracer pulse determined by selecting the injector device individually. Thus, a tracer material expelled from the middle tracer injection device ($T_3$) 60 and detected at the sensor device 140 provides information about the flow stream entering the production tubing 40 at the middle tracer injection device ($T_3$) 60. The downhole sensor device 140 may also be located at the surface. But it may be more desirable in some cases to have the downhole sensor device 140 located closer to the tracer injection point so that the tracer material is less diluted by fluids in the flow stream.

Figure 9B:
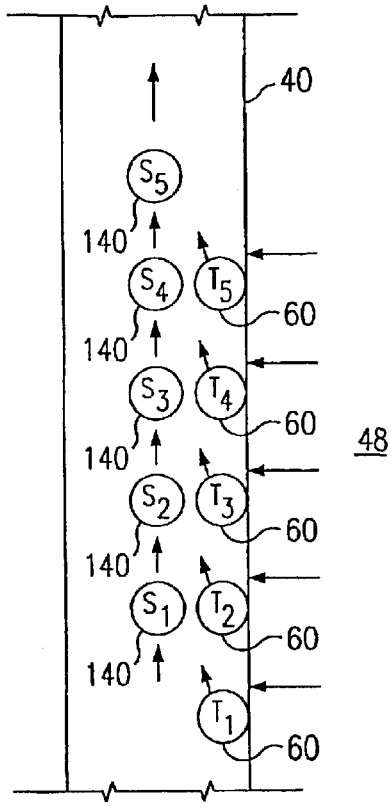

FIG. 9B is a simplified schematic illustrating another possible configuration of the present invention in a vertical production well. In FIG. 9B, there are five downhole tracer injection devices ($T_1$–$T_5$) 60 located at various places along the depth of the vertical well at the production zone 48 for injecting tracer materials within the flow stream at various depths. But instead of having one sensor device 140 as shown in FIG. 9A, in FIG. 9B there are five separate, downhole sensor devices ($S_1$–$S_5$) 140 at various places along the depth of the vertical well. Each sensor device ($S_1$–$S_5$) corresponds to a tracer injection device ($T_1$–$T_5$) 60, respectively. Hence, sensor device $S_4$ comprises a sensor 108 adapted to detect a tracer material expelled from tracer injection device $T_4$. In such a configuration, a sensor device 140 at the same location as a tracer injection device 60 (e.g., sensor device $S_2$ and tracer injection device $T_3$) may be electrically connected to each other, may be electrically connected across a same induction choke, may operate from a same communications and control module, may share a same modem, and/or may be comprised within a same housing.

Figure 9C:
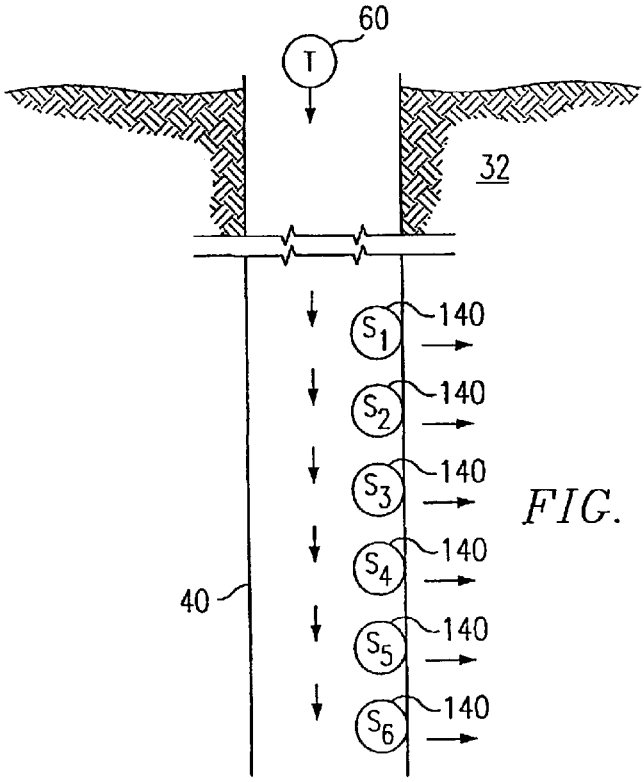

FIG. 9C is a simplified schematic illustrating a possible configuration of the present invention in a vertical injection well. In FIG. 9C, there are six sensor devices ($S_1$–$S_6$) 140 adapted to detect a tracer material injected into the well at the surface by a tracer injection device 60. For injection wells, it will typically only be necessary to inject the tracer materials at the surface because most or all of the flow stream is originating from the surface. However, it is still possible to have one or more tracer injection devices 60 at various locations downhole in addition to or instead of the tracer injection device 60 at the surface.

The configurations of FIGS. 9A–9C can be combined so that the placement of tracer injection devices 60 and sensor devices 140 provides tracer detection and controllable tracer injection for use during both production and injection stages of producing petroleum for a well. Hence, the well can be switch from a producing stage to an injecting stage (and vice versa) without the need to reconfigure tracer injection devices 160 and sensor devices 40 downhole in the well. Therefore, the tracer injection devices 60 and sensor devices 140 can be permanently installed for long term use and for multiple uses.

Figure 9D:
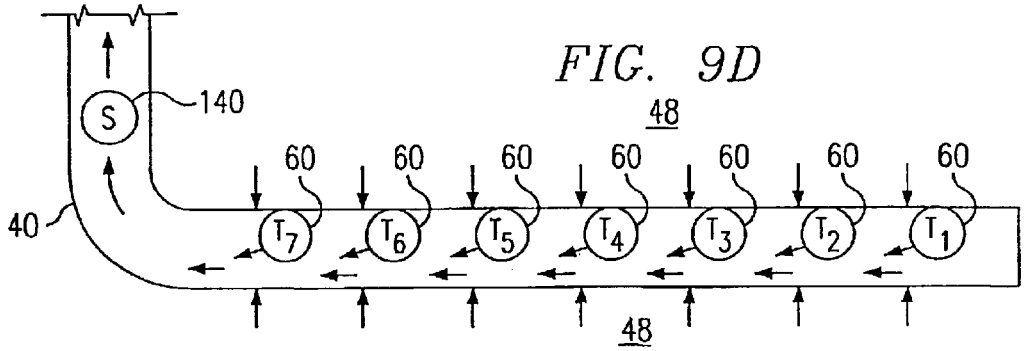

FIG. 9D is a simplified schematic illustrating a possible configuration of the present invention in a production well having a horizontal completion. In FIG. 9D, there are seven downhole tracer injection devices ($T_1$–$T_7$) 60 located at various places along the horizontal section at the production zone 48 for injecting tracer materials within the flow stream at various locations. As in FIG. 9A, a downhole sensor device 140 is located upstream of the tracer injection devices ($T_1$–$T_7$) 60 for detecting tracer materials in the flow stream as they pass.

Figure 9E:
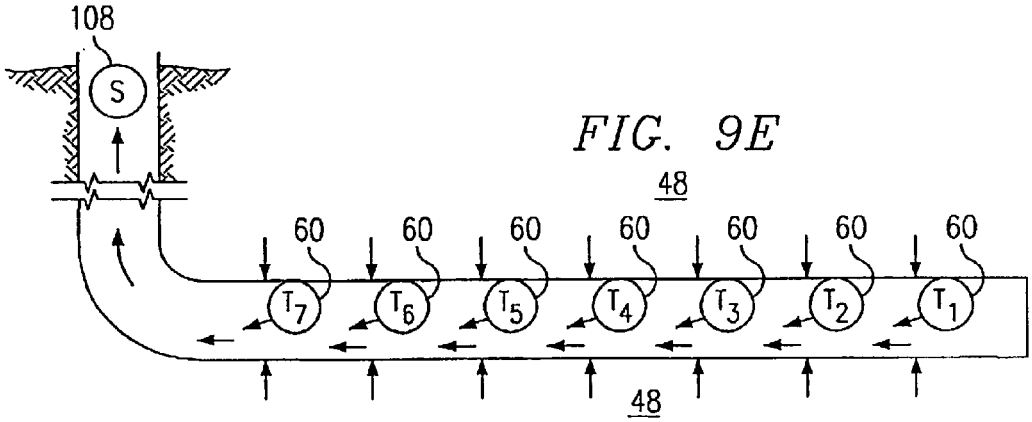

FIG. 9E is a simplified schematic illustrating another possible configuration of the present invention in a production well having a horizontal completion. The configuration in FIG. 9E is the same as the configuration in FIG. 9B, except that a sensor or sensors 108 for detecting the tracer materials is located at the surface. The sensor 108 may be a stand alone sensor device 140, or it may be part of a surface computer system 64.

Figure 9F:
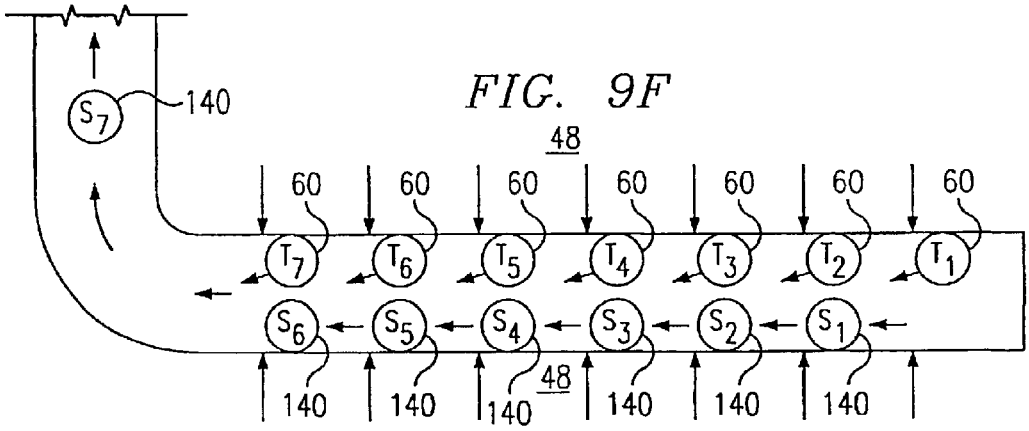

FIG. 9F is a simplified schematic illustrating yet another possible configuration of the present invention in a production well having a horizontal completion. The configuration in FIG. 9F is similar to the configuration in FIG. 9B in that there are multiple sensor devices ($S_1$–$S_7$) 140 corresponding to the multiple tracer injection devices ($T_1$–$T_7$) 60.

Figure 9G:
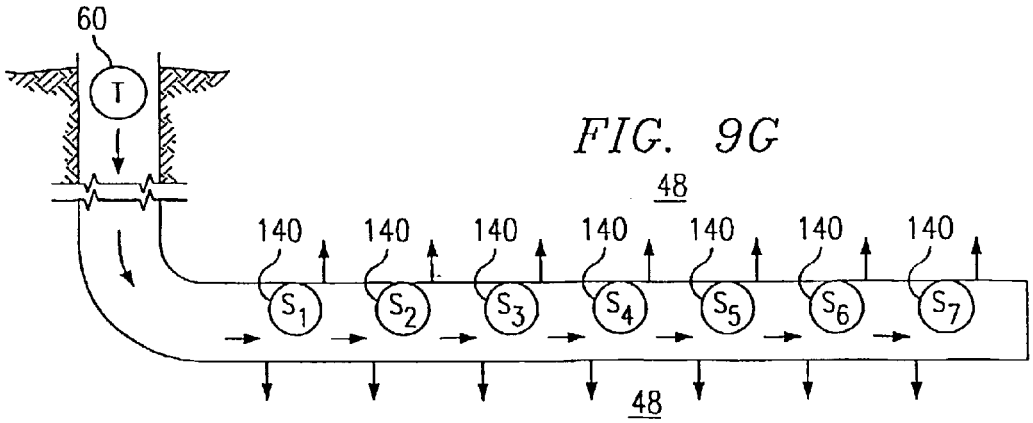

FIG. 9G is a simplified schematic illustrating a possible configuration of the present invention in an injection well having a horizontal section. The configuration in FIG. 9G is similar to the configuration in FIG. 9C in that there are multiple downhole sensor devices ($S_1$–$S_7$) 140 adapted to detect tracer material injected into the well at the surface by a tracer injection device 60. In alternative, the tracer injection device 60 may be located downhole.

Figure 9H:
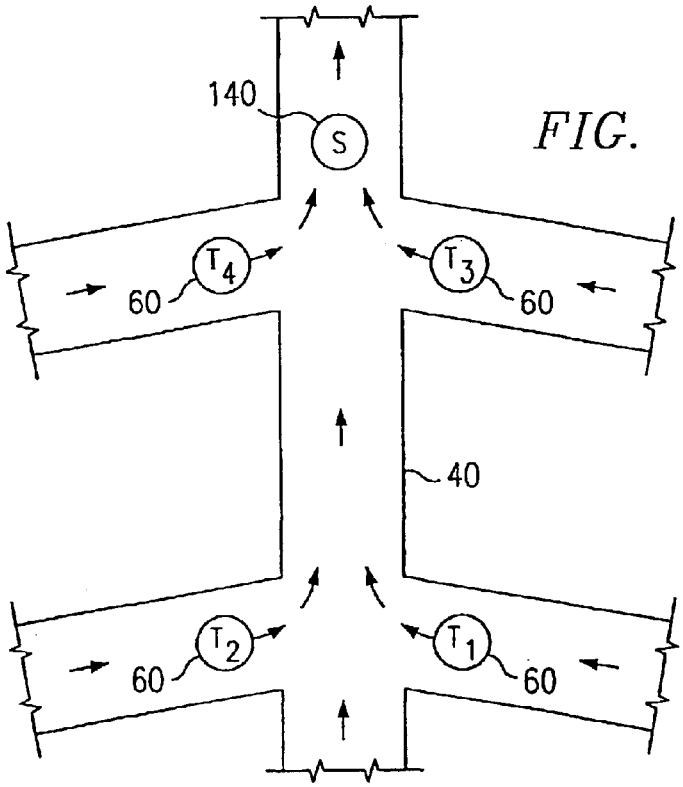

FIG. 9H is a simplified schematic illustrating a possible configuration of the present invention in a production well having multiple lateral completions. In FIG. 9H, there are tracer injection devices ($T_1$–$T_4$) 60 within the lateral branches, with each tracer injection device 60 being near the junction between a lateral branch and the main borehole. Such placement of the tracer injection devices ($T_1$–$T_4$) 60 has the advantage of ease in installation (relative to installing a device farther downhole within a lateral branch). A sensor device 140 is located upstream of the uppermost lateral branch. The sensor device 140 is adapted to detect tracer materials injected into the lateral branches by the tracer injection devices ($T_1$–$T_4$) 60. Hence, the sensor device 140 may comprise multiple sensors 108 adapted to detect multiple tracer material signatures. In alternative, the sensor device 140 or sensors 108 may be located at the surface, but the downhole location shown in FIG. 9H is sometimes more preferred.

Figure 9I:
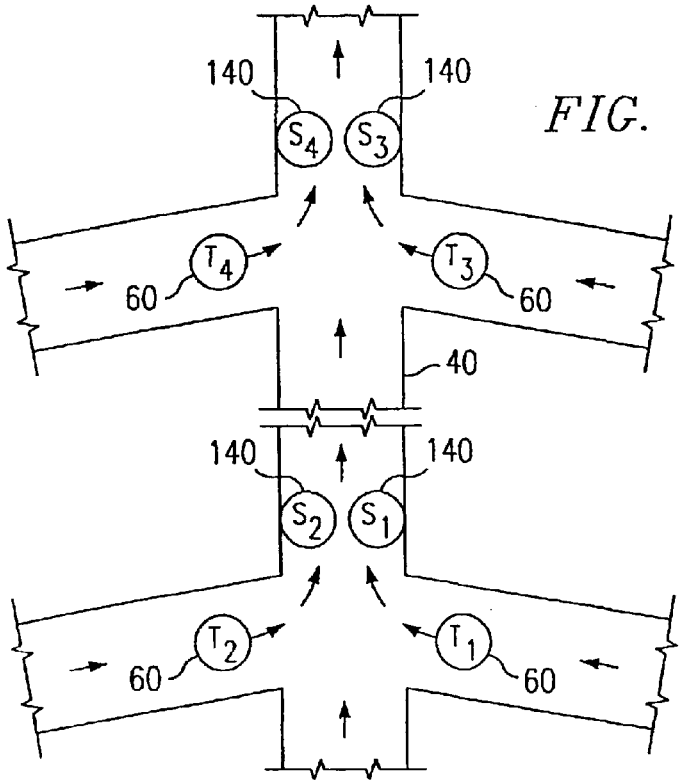

FIG. 9I is a simplified schematic illustrating another possible configuration of the present invention in a production well having multiple lateral completions. In FIG. 9I, as in FIG. 9H, there are tracer injection devices ($T_1$–$T_4$) 60 shortly within the lateral branches. But in FIG. 9I, there are four sensor devices ($S_1$–$S_4$) 140, one for each tracer injection device ($T_1$–$T_4$) 60, respectively. Hence, sensor device $S_3$ is adapted to detect a tracer material injected into the flow stream by tracer injection device $T_3$, which provides flow information regarding the lateral branch having tracer injection device $T_3$ therein. Because sensor devices $S_3$ and $S_4$ are located at the same location, they may be combined into a single sensor device 140 having multiple sensors 108.

Figure 9J:
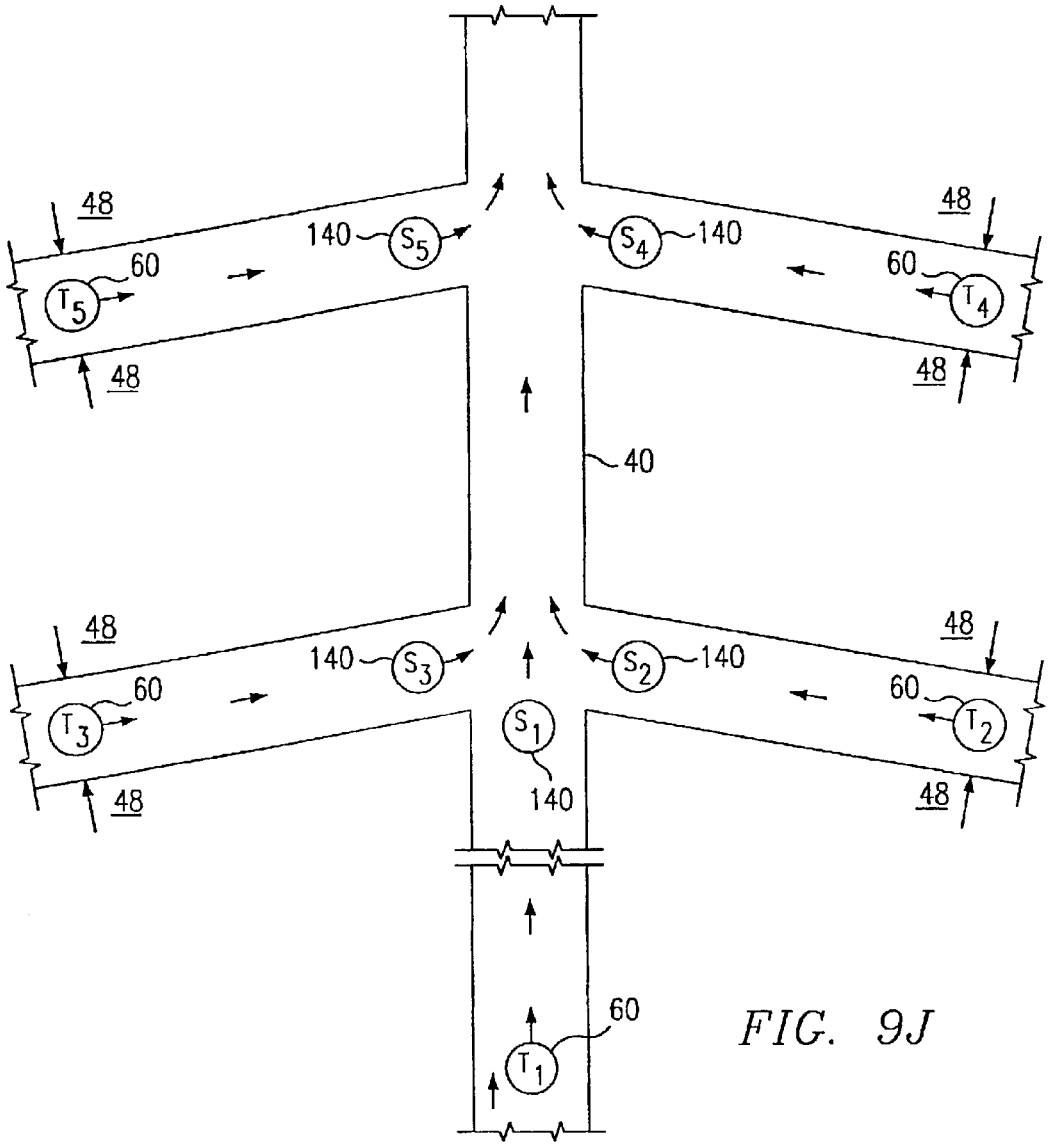

FIG. 9J is a simplified schematic illustrating yet another possible configuration of the present invention in a production well having a multiple lateral completions. In FIG. 9J, tracer injection devices ($T_2$–$T_4$) 60 are located within the lateral branches near the production zones 48, and a tracer injection device ($T_1$) 60 is located within the vertical portion below the lateral branches. Sensor devices ($S_2$–$S_4$) 140 are located upstream of the tracer injection devices ($T_2$–$T_4$) 60, respectively, within the laterals near the vertical section. A sensor device ($S_1$) is located up stream of tracer device ($T_1$) and below the lateral branches. Hence, the flow stream in each section of the well can be independently monitored.

For the configurations illustrated in FIGS. 9A–9J where there are multiple tracer injection devices 60 and/or multiple sensor devices 140, the tracer injection devices 60 and/or the sensor devices 140 may be located at equally spaced intervals. However, the multiple tracer injection devices 60 and/or the sensor devices 140 may also be randomly spaced from each other or at any other spacing arrangement. Furthermore, each of the multiple tracer injection devices 60 and/or the sensor devices 140 may have its own induction choke to provide power and/or communications, or some or all of the tracer injection devices 60 and/or the sensor devices 140 may share an induction choke. Because the tracer injection devices 60 and the sensor devices 140 can be independently addressable and independently controlled, one or more well sections can be independently monitored.

Below are numerous calculations to illustrate how information or measurements obtained while using the present invention can be used to determine fluid movement or flow characteristics of a well during production or injection. The calculations provided below are posed for inflow of fluids into a production well. However with slight modification, they also can be applied to injection well profiles in which tracer is injected at one location at the top of the interval, and arrival time is observed at spaced monitors along the open interval.

Definitions:

$\Delta x_i$=thickness of layer i [ft]

h=total thickness of interval [ft]

$i_i$=inflow rate into well per unit length from layer i [barrels/day/ft]

$q_i=i_i\Delta x_i$=flow rate into well from layer i [barrels/day]

$q_T=\Sigma q_i$=total flow rate into well [barrels/day]

$Q_i$=flow rate inside well at depth of layer i [barrels/day]

$Q_T$=total flow rate out of well=$q_T$ [barrels/day]

n=interval number (counted from top down)

N=total number of intervals $v_\beta$=volume of injected tracer pulse [cc]

$c_\beta$=concentration of tracer in injected pulse [gm/cc]

$v_\beta c_{62}$ =mass of tracer injected [gm]

r=radius of well [ft]

$t_i$=transit time across layer i

Assumptions:

$$\Delta x_1=\Delta x_2=\Delta x_3= \ldots \Delta x_n \quad (1)$$

$$i_1\Delta x_1+i_2\Delta x_2+i_3\Delta x_3 \ldots +i_n\Delta x_n=q_T \text{ (no crossflow)} \quad (2)$$

CASE I Uniform Inflow $$i_i=\text{constant } [bbls/\text{day}/ft] \quad (3)$$

The flow rate in the well at layer i is the sum of the inflow rates in all of the layers below, and in, layer i:

$$Q_i=q_N+q_{N-1}+ \ldots +q_i \quad (4)$$

The transit time across layer i is:

$$t_i = (\pi r^2 \Delta x_i)/(Q_i) = (\pi r^2 \Delta x_i) \Big/ \left(\sum_N^i i_i \Delta x_i\right) = (\pi r^2) \Big/ \left(\sum_N^i i_i\right) \quad (5)$$

The total transit time from inflow from layer k to the top of the interval is:

$$t_{Tk} = t_1 + t_2 + t_3 \quad (6)$$

$$t_{Tk} = \Sigma_1^k t_I \quad (7)$$

An example calculation for four layers with a constant rate of inflow is given below. Beginning at the bottom of the interval, the flow rate inside the well increases as each layer successively feeds into the well (see Table 1, Column 2). For this case in which layer thicknesses are equal, the well volume opposite each layer is equal. Therefore the transit time of fluids in the well across that layer is inversely proportional to the flow rate in the well (see Table 1, Column 3). Now summing these layer transit times from the top down to a layer in which a tracer has been injected in the well stream, gives the total transit time for a tracer to arrive at the top of the producing interval (see Table 1, Column 4). Injected tracer is diluted by inflow fluids that enter above the tracer injection point. Thus, the concentration of tracer that arrives at the top of the interval relative to the initial injected concentration may be calculated by dividing the flow rate in the well at the injection point by the flow rate at the top of the interval, that is, by the total flow rate (see Table 1, Column 5).

TABLE 1

| Layer | Flow Rate in Well | Layer Transit Time $t_i = \pi r^2/\Sigma i_i$ | Total Transit Time $t_{Tk} = t_1 + t_2 + t_3 + t_4$ | Arrival Concentration |
|---|---|---|---|---|
| 1 | $q_1 + q_2 + q_3 + q_4$ | $\pi r^2/4i_i$ | $(\pi r^2/i_i)(1/4)$ | 4/4 |
| 2 | $q_1 + q_2 + q_3$ | $\pi r^2/3i_i$ | $(\pi r^2/i_1)(1/4 + 1/3)$ | 3/4 |
| 3 | $q_1 + q_2$ | $\pi r^2/2i_i$ | $(\pi r^2/i_i)(1/4 + 1/3 + 1/2)$ | 2/4 |
| 4 | $q_1$ | $\pi r^2/1i_i$ | $(\pi r^2/i_i)(1/4 + 1/3 + 1/2 + 1/1)$ | 1/4 |

Figure 10:
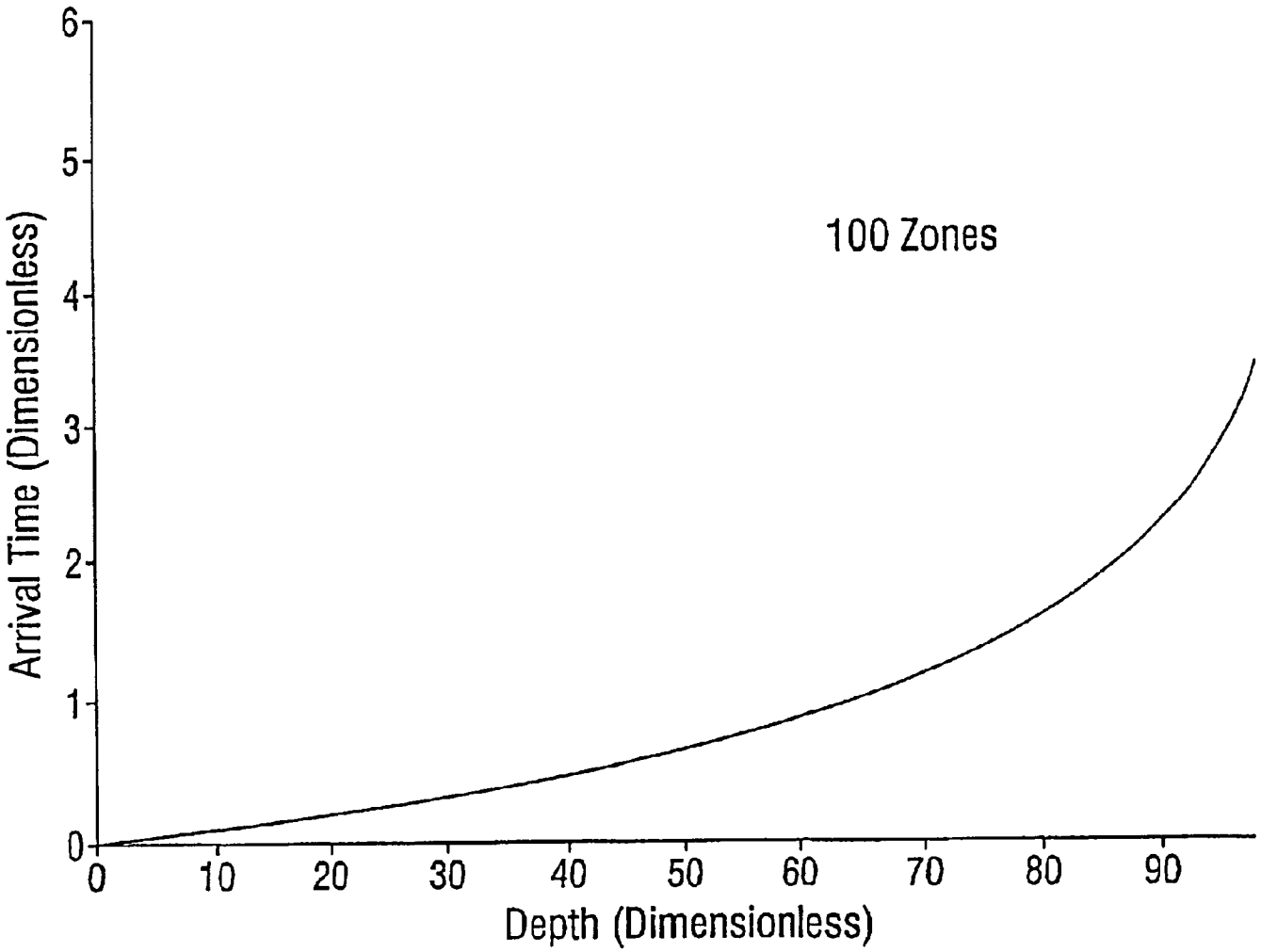
FIG. 10 graphs normalized arrival time on the ordinate as a function of normalized depth on the abscissa for a simulation of inflow using 100 inflow zones.

FIG. 10 illustrates the relative arrival times at the top of the interval for fluids entering the well at 100 locations along the interval.

Figure 11:
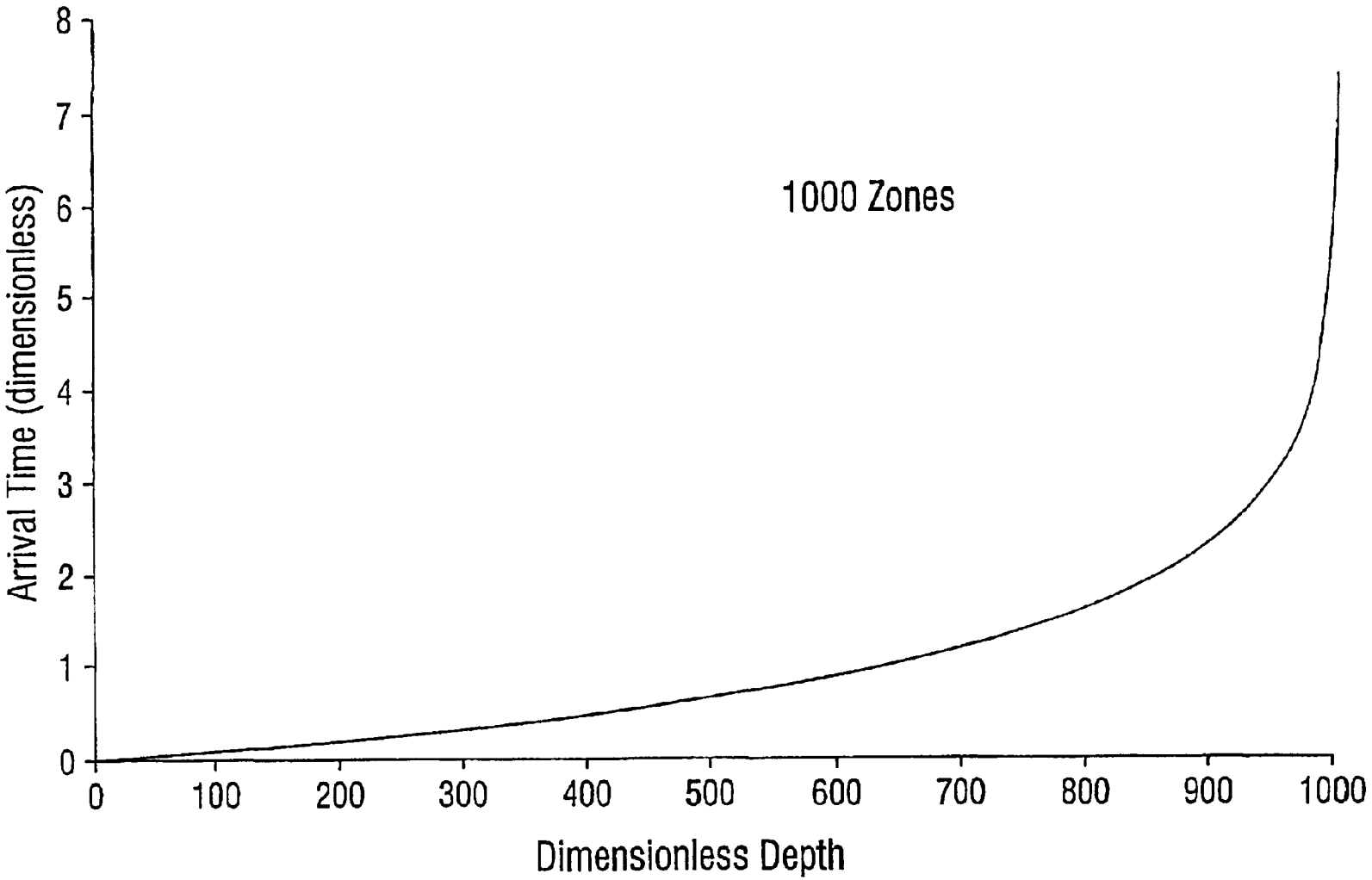
FIG. 11 graphs normalized arrival time on the ordinate as a function of normalized depth on the abscissa for a simulation of inflow using 1000 inflow zones.
Figure 12:
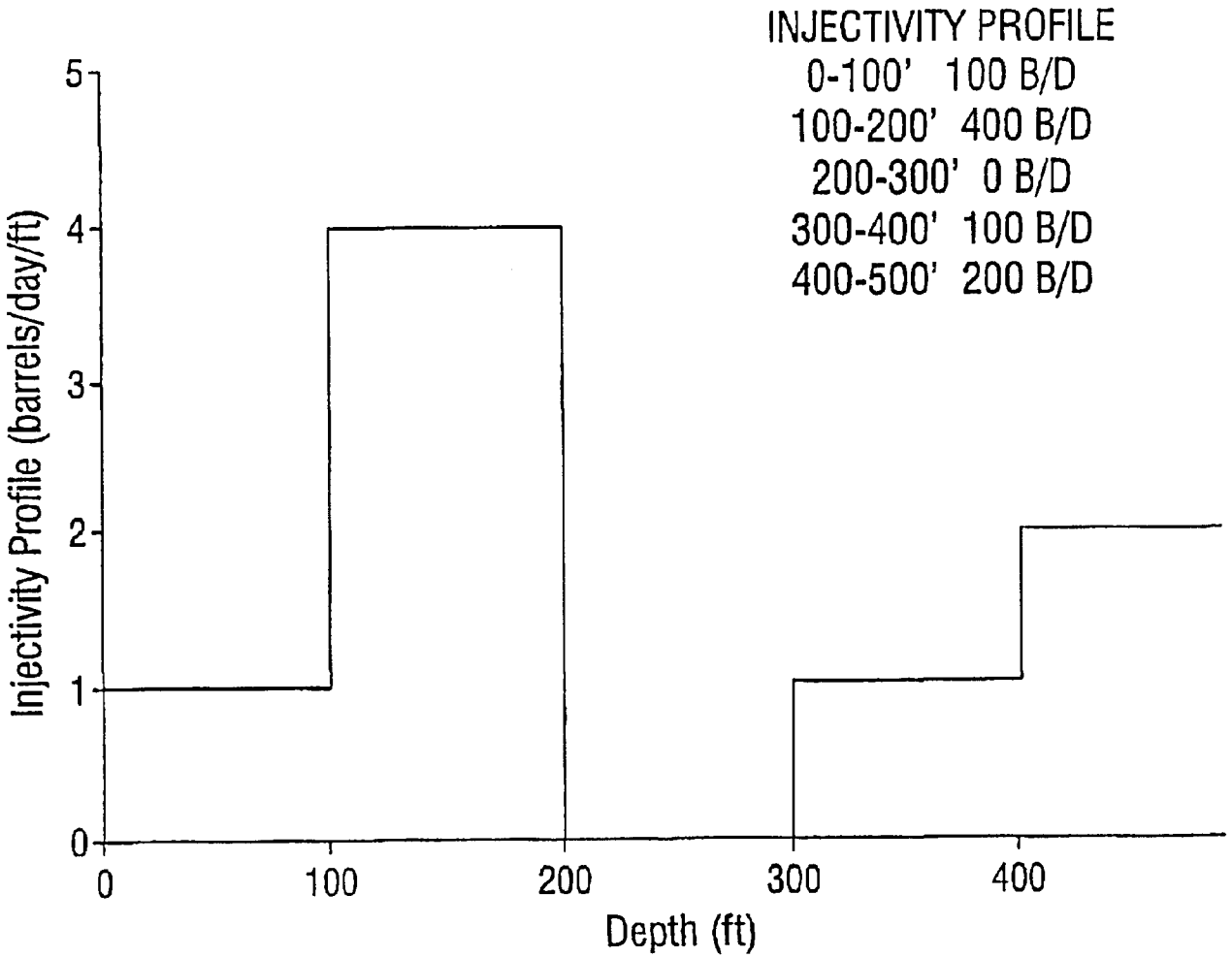
FIG. 12 defines the injectivity profile of an illustrative injection well by graphing injectivity profile on the ordinate as a function of depth on the abscissa.

FIG. 11 illustrates the relative arrival times at the top of the interval for fluids entering the well at 1000 locations along the interval.

CASE II Variable Inflow/Variable Layer Thickness

For this more complex case, the flow rate of fluid entering a vertical well from a layer is a function of the permeability ratio (k), the thickness ($\Delta y_i$) and the normalized inflow rate determined by the pressure gradient.

$$q_i = k_i i_i \Delta y_i = \text{flow rate into well from layer } i \text{ [barrels/day]} \quad (8)$$

Where, $i_i$=constant [bbls/day/*ft*]

Again, the flow rate in the well at layer i is the sum of the inflow rates in all of the layers below, and in layer i:

$$Q_i = q_N + q_{N-1} + \ldots + q_i \quad (9)$$

Where inflow is summed from bottom up to layer i, the transit time across layer i is:

$$\Delta t_i = (\pi r^2 \Delta y_i)/(Q_i) = (\pi r^2 \Delta y_i)/\Sigma_N^i (\Delta i_j k_j \Delta y_j) \quad (10)$$

The total transit time of fluids in the well from inflow at layer i to the top of the interval is: (Transit times are summed from layer 1 at the top of the interval down to layer i.)

$$\Delta t_{Ti} = \Delta t_1 + \Delta t_2 + \ldots + \Delta t_i \quad (11)$$

$$\Delta t_{Ti} = \Sigma_1^i \Delta t_k \quad (12)$$

Wells with Multiple Lateral Horizontal Completions

When wells are completed with multiple lateral horizontal branches, as shown in FIGS. 9H–9J, the productivity of individual branches cannot be determined by conventional logging or profile measurements. Information on the productivity of individual laterals would be useful in reservoir management that might lead to workovers or infill wells in the direction of poorly completed laterals. Similarly, if the production from a well, as observed at the surface, displays a sudden increase in water or gas, it is useful to determine which lateral is causing the problem. In the simplest application of the use of tracers for lateral well diagnosis, the tracer injection point may be located a short distance into the lateral by any of the methods of placement discussed above (see FIGS. 9H and 9I). The detector may be located in the vertical section of the well above the uppermost lateral. Laterals having low productivity will display long, dilute tracer response, because the transit time in that lateral is long compared to that in the vertical pipe.

Injection Wells with Long Vertical Open Intervals

In formations being water flooded over long intervals, the maintenance of uniform injection profiles is essential to assure effective flood-out of the whole oil bearing zone. In a typical injection well completion, fluid is injected through tubing under a packer and allowed to enter the objective zone through perforations in the casing pipe or through a screened liner. In this application a number detectors may be installed along the casing or liner, or preferably along a perforated extension of the tubing below the packer (see FIG. 9C). With this configuration, the tracer may be injected at the surface, and the arrival time at the various detectors used to determine the injectivity profile. With surface readout of the detectors, a complete history of the fluid injection profile throughout the flooded zone can be obtained. In the case of injection wells, particular care must be taken to mix the injected tracer thoroughly to avoid segregated flow near the wall of the pipe. The reason for this is that fluids are leaving the well at the wall; hence tracer that stays near the wall will exit the well in the upper layers and not be available for measurements on the lower zones.

An example is given below to demonstrate how tracer arrival times observed at widely spaced monitors can be used to calculate the injection profile in a heterogeneous interval composed of zones having widely variable permeabilities.

Example Water Injection Well:

| | |
|---|---|
| Diameter: | d = 6 inches. |
| Well Completion: | 101' of unperforated pipe below packer; 500' of perforated interval; |
| Total Injection Rate: | 800 barrels per day. |
| Injectivity profile: | See FIG. 1 |

TABLE 2

INJECTION PROFILE
Tracer Injection at packer, 101 feet above open interval;
Tracer Monitoring Devices at 50' spacing over open interval.

| ZONE | DEPTH | RATE |
|---|---|---|
| Zone I | 0–100 ft. | 100 barrels/day |
| Zone II | 100–200 ft. | 400 barrels/day |
| Zone III | 200–300 ft. | 0 barrels/day |
| Zone IV | 300–400 ft. | 100 barrels/day |
| Zone V | 400–500 ft. | 200 barrels/day |

The time in minutes for the tracer to travel from one location to the next is:

$$\begin{aligned} t_i &= (\pi r^2)(\Delta y_i)/(Q_i) \\ &= [(\pi/4)(1/d)^2(1440)/5.615](\Delta y_i)/(Q_i) \\ &= [(201.42)(1/d)^2](\Delta y_i)/(Q_i) \\ &= [(201.42)(1/2)^2](\Delta y_i)/(Q_i) \end{aligned} \tag{13}$$

$$t_i=(50.355)(\Delta y_i)/(Q_i) \tag{14}$$

Therefore, the time for the tracer to travel from the injection point to the top of the open interval is:

$$t_o=(50.355)(\Delta y_o)/(Q_o)$$

$$t_o=(50.355)(101)/(800)=6.357319 \text{ minutes}$$

Thereafter, the rate in the well decreases as water leaves the perforated interval. Using very short intervals ($\Delta y_i$=1 ft), the inverse velocity or transit time ($\Delta t_i$) can be calculated for each depth:

$$\Delta t_i=(50.355)(\Delta y_i)/(Q_{avg})=(50.355)(\Delta y_i)/(Q_{i-1}+Q_i)/2 \tag{15}$$

For the first 100 feet, the injectivity is 1 b/d/ft, $$\Delta t_1=(50.355)(1)/(800+799)/2=0.062983 \text{ min}$$

$$\Delta t_2=(50.355)(1)/(799+798)/2=0.063062 \text{ min}$$

. . .

$$\Delta t_{100}=(50.355)(1)/(701+700)/2=0.071884 \text{ min}$$

For the second 100 feet, the injectivity is 4 b/d/ft, $$\Delta t_{101}=(50.355)(1)/(700+696)/2=0.072142 \text{ min}$$

. . .

$$\Delta t_{200}=(50.355)(1)/(304+300)/2=0.166738 \text{ min}$$

For the third 100 feet, the injectivity is 0 b/d/ft, $$\Delta t_{201}=(50.355)(1)/(300+300)/2=0.16785 \text{ min}$$

. . .

$$\Delta t_{300}=(50.355)(1)/(300+300)/2=0.16785 \text{ min}$$

For the fourth 100 feet, the injectivity is 1 b/d/ft, $$\Delta t_{301}=(50.355)(1)/(300+299)/2=0.16813 \text{ min}$$

. . .

$$\Delta t_{400}=(50.355)(1)/(201+200)/2=0.25114 \text{ min}$$

For the fifth 100 feet, the injectivity is 2 b/d/ft, $$\Delta t_{401}=(50.355)(1)/(200+198)/2=0.25304 \text{ min}$$

. . .

$$\Delta t_{500}=(50.355)(1)/(2+0)/2=50.335 \text{ min}$$

Figure 13:
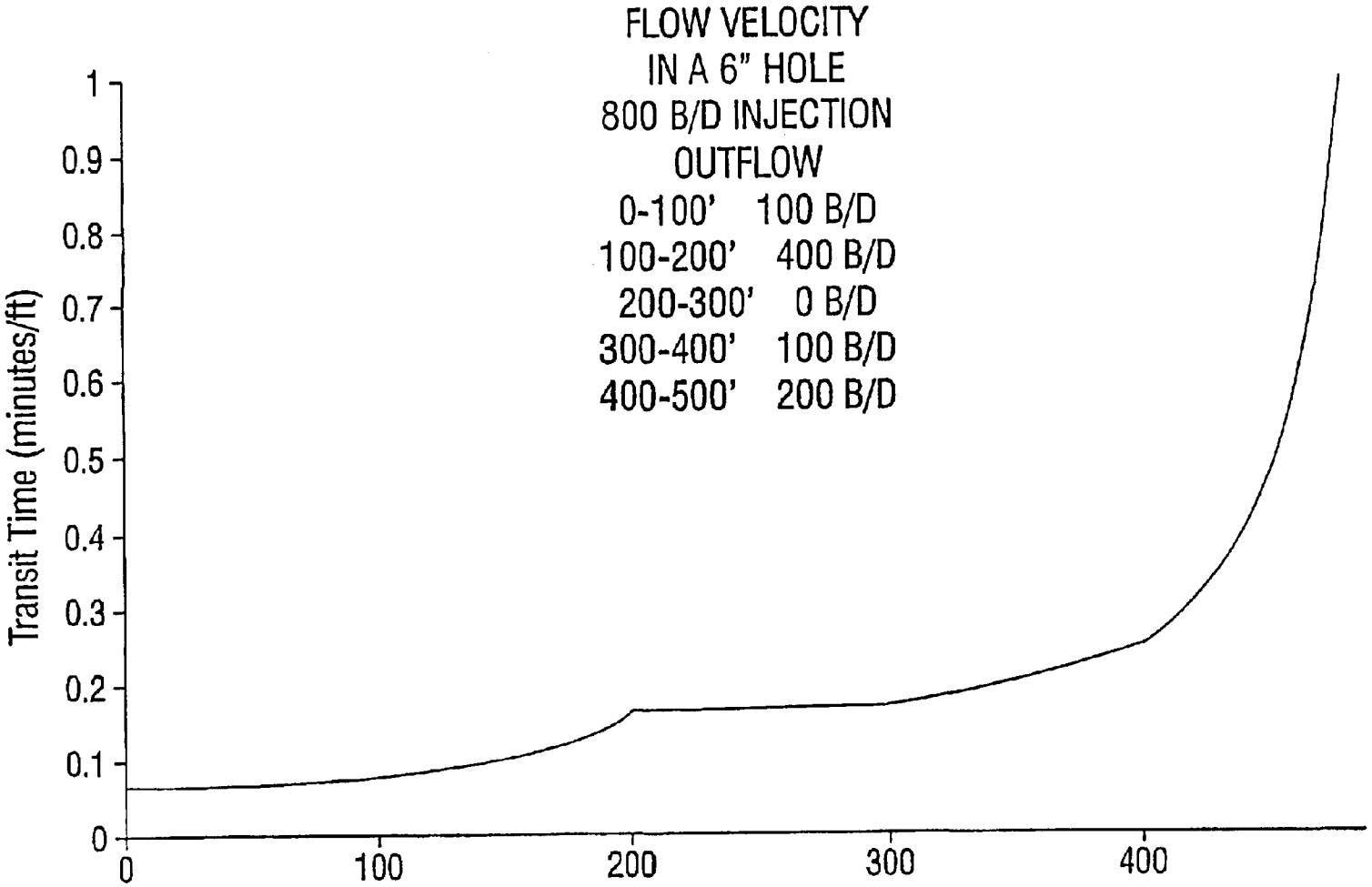
FIG. 13 graphs the tracer transit time per unit length of the illustrative injection well defined in FIG. 12 by depicting transit time on the ordinate as a function of depth on the abscissa.
Figure 14:
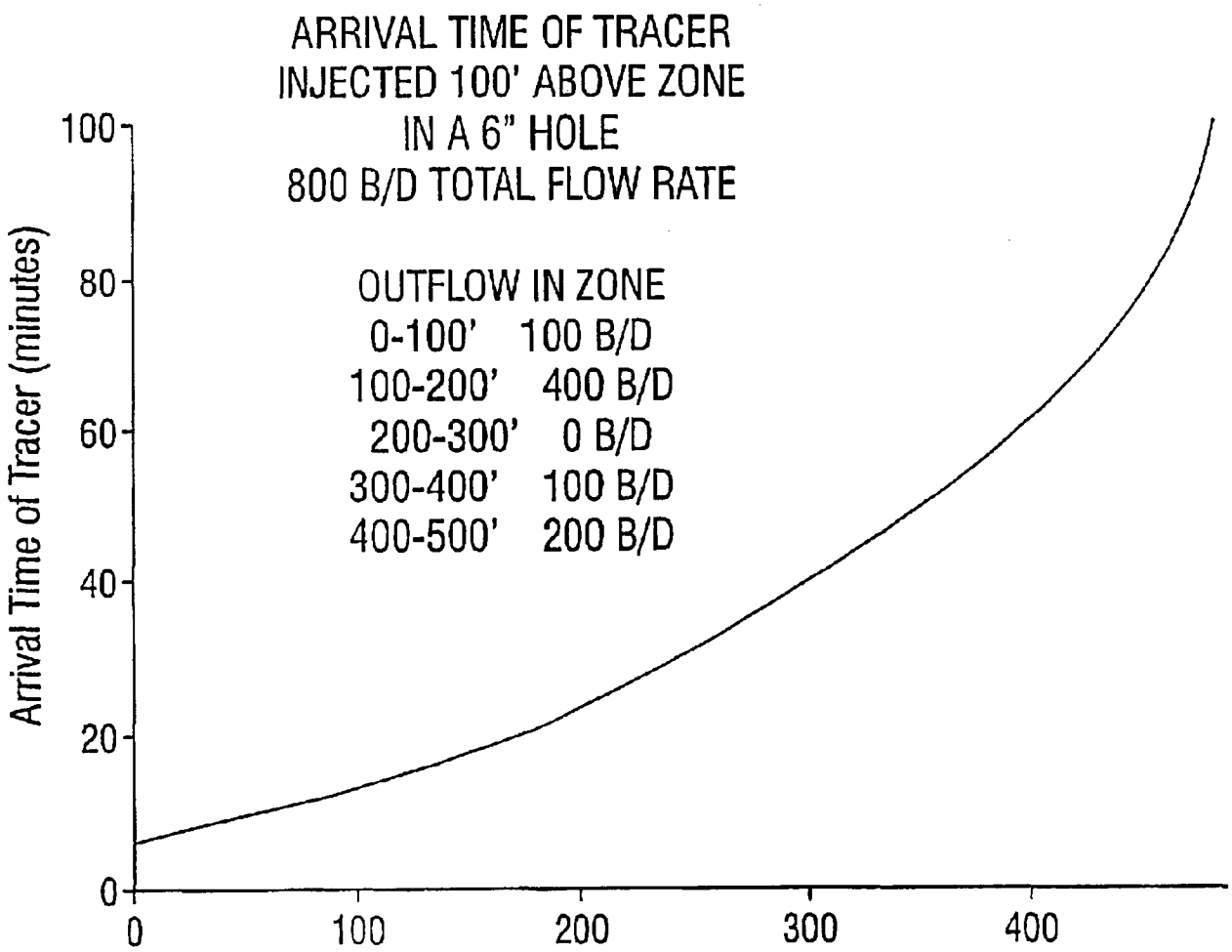
FIG. 14 graphs the arrival time of tracer in the illustrative injection well defined by FIG. 12 by depicting arrival time on the ordinate as a function of depth on the abscissa.

FIG. 13 shows that these calculations closely approximate the actual flow rates that would be observed in a well with the injection profile given above. FIG. 14 shows the cumulative sum of all of the interval times:

$$t_{Tk}=t_o+\Sigma_j^{500}\Delta t_k \tag{16}$$

and we note that only subtle changes in arrival times are seen in this display even though injectivities vary from 0 to 4 b/d/ft.

The number of monitoring points is limited by practical considerations. If tracer monitoring modules are spaced at 50 foot intervals the arrival times at these positions may be used to calculate injection rates as a function of depth as follows:

$$t_{50} = t_o + \Delta t_{50} \tag{17}$$

$$= t_o + (50.355)(\Delta y_{50})/(Q_{50} + Q_o)/2 \tag{18}$$

Knowing the flow rate being injected into the well and the arrival times of the tracer at the top of the open interval and at 50 feet down, we may calculate the rate in the well at that depth ($Q_{50}$), $$\begin{aligned} Q_{50} &= [(100.71)(\Delta y_{50})/(t_{50} - t_o)] - Q_o \\ &= [(100.71)(50)/(9.607156 - 6.357319)] - 800 \\ &= 749.4624 B/D \end{aligned} \tag{19}$$

Using the calculated rate and the arrival times of tracer at that depth, we may solve for the flow rate ($Q_{100}$) at the next monitor from the arrival time at that depth (100 feet).

$$\begin{aligned} Q_{100} &= [(100.71)(50)/(13.08129 - 9.607156)] - 749.4624 \\ &= 699.9629 B/D \end{aligned}$$

Successively, we calculate flow rates at each monitor down to the bottom of the interval.

Figure 15:
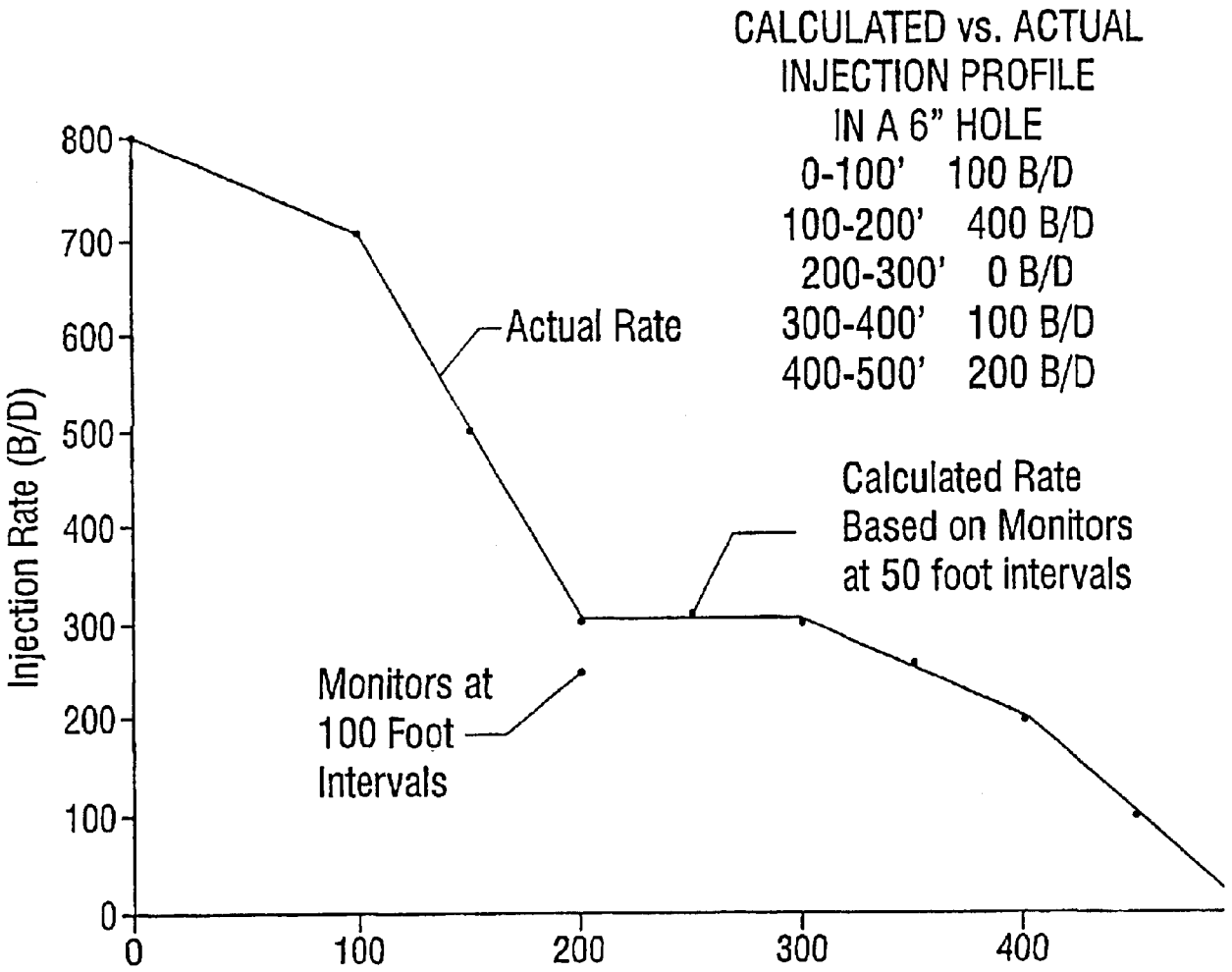
FIG. 15 compares calculated and actual injection rates as a function of depth in the illustrative injection well defined by FIG. 12 by graphing injection rate on the ordinate as a function of depth on the abscissa.

FIG. 15 compares the actual flow rates with the values calculated from the 50 foot readings. Correspondence is good, with the exception of the bottom location where flow rate goes to zero and transit times become infinite.

This method of calculating flow rates can be applied to longer spacing as well. However, when the fraction of total flow entering the formation in the interval between two monitors is large compared to that passing the upper monitor, significant errors are introduced. For example, if 100 foot spacing is used in the calculation above, the predicted flow rate is too low in Zone II where the true well flow rate decreases from 700 b/d to 300 b/d, as shown in FIG. 15. The reason for this deviation is the use of the interval average flow rate for matching the interval transit time.

If the transit time of the zone ($\Delta t_I$) is matched to a series of $N_s$ transits of subzones each of which reflects an equal loss of fluid into the formation, a corrected flow rate at the bottom of the zone ($Q_N$) is obtained as follows:

$$\Delta t_I = (50.355)(\Delta y_n)\{[1/Q_0] + [1/(1/N_s)(Q_0 - Q_N)] + [1/(2/N_s)(Q_0 - Q_N)] + [1/(3/N)(Q_0 - Q_N)] \ldots + [1/(N_s/N_s)(Q_0 - Q_N)] \quad (20)$$

$$\Delta t_I(Q_0)/(50.355)(\Delta y_n) = \{[1] + [1/(1 - (1/N_s) + (1/N_s)(Q_N/Q_0))] + [1/(1 - (2/N_s) + (2/N_s)(Q_N/Q_0))] + [1/(1 - (3/N_s) + (3/N_s)(Q_N/Q_0))] + \ldots + [1/(1 - (N_s/N_s) + (N_s/N_s)(Q_N/Q_0))]\} \quad (21)$$

The transit time of the zone ($\Delta t_I$) is known from arrival time observations at the top and bottom of the zone. The sub-zone thickness ($\Delta y_n$) is equal to the thickness of the zone divided by the number of sub-zones selected ($N_s$). The well flow rate at the top of the zone ($Q_0$) is obtained from the calculated value of flow rate at the base of the previous zone. The flow rate at the bottom of the present zone ($Q_N$) is obtained by iteration since an explicit solution of $Q_N$ in Equation 21 is not available.

Production Wells with Long Vertical Open Intervals

Inflow profiles of long interval vertical production wells can be analyzed by a method similar to that described above. However, there are some differences that must be taken into account. In an injection well, the tracer can be injected at a single point at the surface in the flow stream that is moving at the maximum velocity (see FIG. 9C). The tracer will pass along the well at a diminishing velocity. The only part of the well not amenable to tracer arrival is the very bottom section where flow rate becomes negligible. In the case of a production well, the tracer must be injected below the interval being analyzed (see FIGS. 9A and 9B). Near the bottom, flow rates will be small, and concentrations of tracer will be continuously diluted by inflow from the formation as the tracer moves uphole. In practical applications, the arrival times of tracer injected near the bottom will be too long and its concentration will be too low to obtain useful information in the upper part of the formation. A less complete definition of productivity profile can be obtained by using pairs of tracer injection modules with detection modules.

Unlike injection wells where the tracer moves radially outward as the flow stream moves down the hole, production wells exhibit a radially inward movement as the produced fluids move up the hole. Unless mixing occurs, a tracer injected at the wall will eventually occupy the very center of the well as it flows up the well. This means that there is no danger of the tracer exiting the well, but care must be taken at the detection point to avoid missing the passage of the tracer when the detector is located at the wall. One possible solution is the use of turbulators in the well located immediately below the detectors to assure that tracer passes at the wall.

The analyses above presume a dominant phase flowing in the well that can be observed by a single tracer. In practice, most production wells have combinations of oil, water, and gas flowing in the well. Under these conditions, the buoyant forces may result in a rapid transport of phases compared to the average fluid velocity. A wide variety of downhole conditions exist in commercial oil and gas wells, and many opportunities are available for the use of downhole detectors for specific production conditions. These conditions should be evident to those skilled in production well practice.

An example of useful information that might be obtained by such devices is the location of entry points for water or gas. In water flooding, there is often a difference in salinity of the original formation water and the injected flood water. The arrival of fresh water at the surface at individual wells of a water flood has been used for many years to monitor breakthrough. However, in long interval wells there is no simple way to learn the specific zone in the vertical section that is breaking through. Permanently mounted detectors located along the open interval can be used to monitor the progress of a flood and provide guidance for remedial work to exclude the water breakthrough.

An example calculation is given below to demonstrate how arrival times of produced fluids at the top of an interval can be used to infer productivity profiles as a function of depth. Equations 3–12 given above are used in this calculation.

Example Vertical Production Well:

TABLE 3

DIMENSIONLESS PRODUCTIVITY PROFILES

| PROFILE | DEPTH [1] | RATE [$1^3$/t/l] |
|---|---|---|
| Uniform | 0–100 | 1X |
| Chart A | 0–50 | 2X |
| | 50–100 | 0 |
| Chart B | 0–50 | 0 |
| | 50–100 | 2X |
| Chart C | 0–10 | 5X |
| | 10–90 | 0 |
| | 90–100 | 5X |

Figure 16:
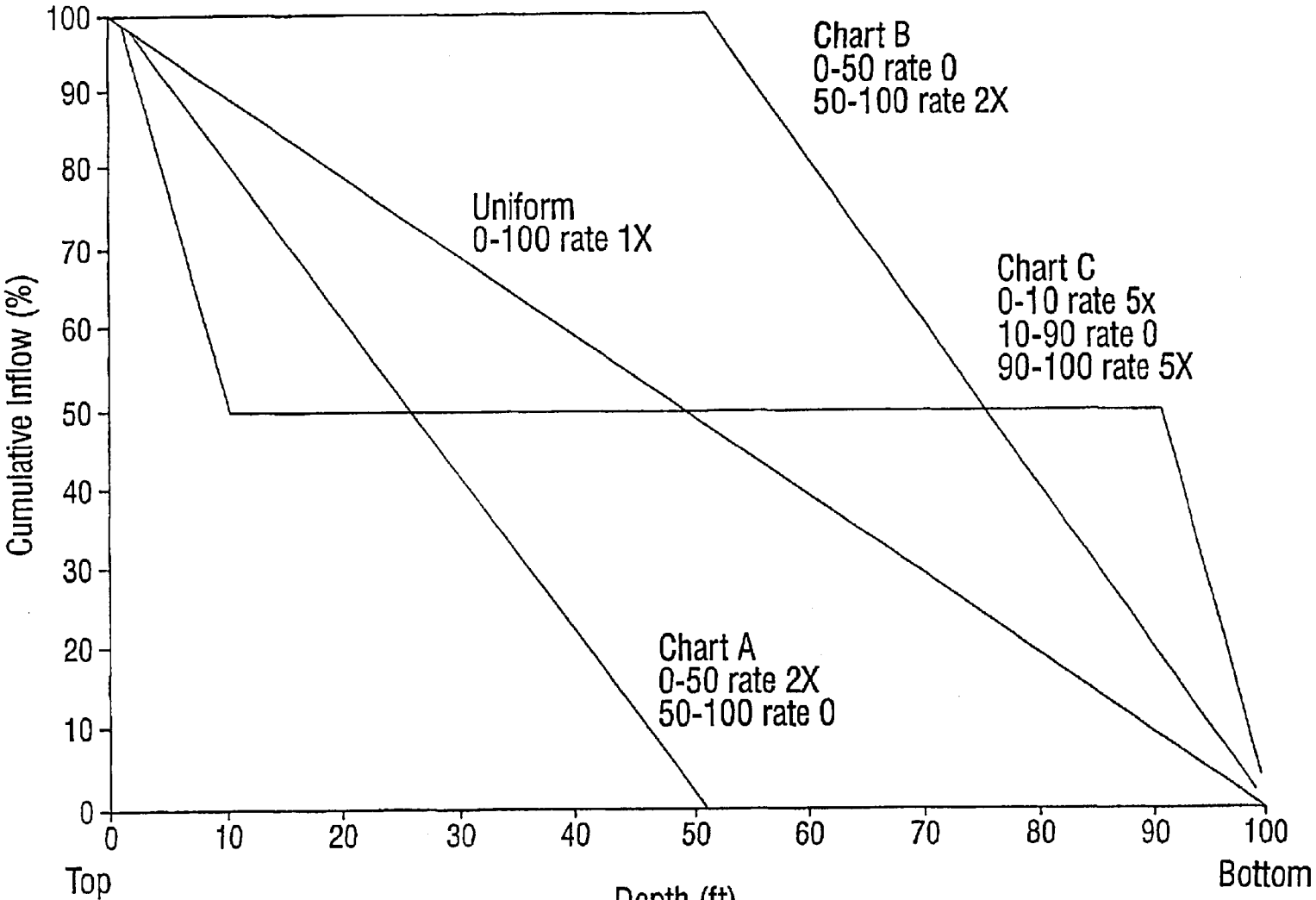
FIG. 16 defines four illustrative cases of production wells by graphing cumulative inflow on the ordinate as a function of depth on the abscissa.
Figure 17:
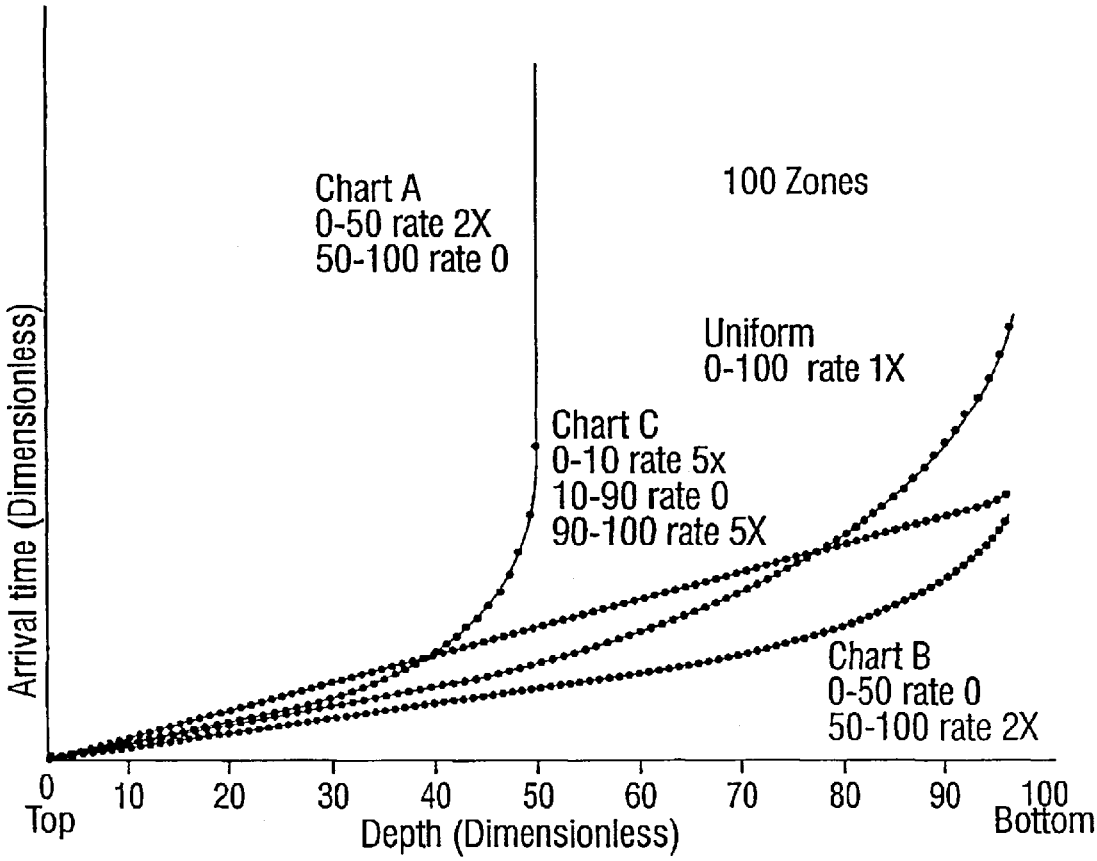
FIG. 17 graphs normalized arrival time of an injected tracer on the ordinate as a function of depth for the four illustrative cases of production wells defined in FIG. 16.

FIG. 16 shows cumulative inflow of fluids as a function of depth for these four profiles. FIG. 17 compares arrival times for cases of Charts A–C as defined in TABLE 3 and FIG. 16. Compared to a uniform inflow profile, large differences in arrival times are observed when flow is non-uniform. In each of these profiles the total dimensionless flow rate is 1.0. For uniform inflow, the rate per unit depth is 1×. When all of the flow is in the upper half, at a rate of 2× (Chart A), no transport of fluid occurs in the lower half and arrival time becomes infinite for fluid entering at the midpoint of the interval. When all of the flow is in the lower half at a rate of 2× (Chart B), arrival times are short throughout the interval. When flow rate occurs only in the in the bottom and top 10% of the interval at 5× (Chart C), the transit times of fluids from the bottom are faster than for the uniform case and then become slower than the uniform case for fluids entering near the top.

Figure 18:
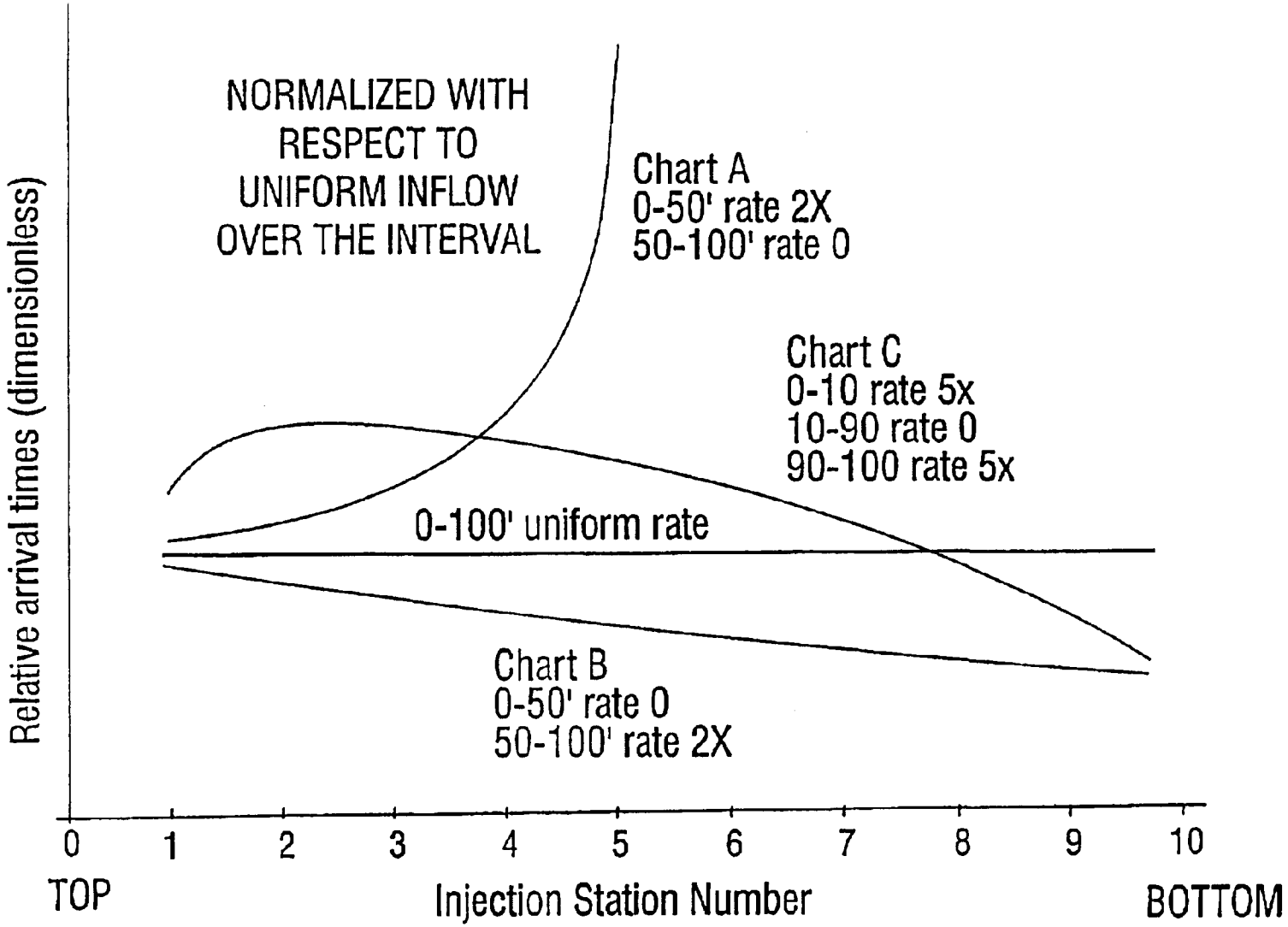
FIG. 18 graphs normalized arrival time of an injected tracer relative to a uniform injection rate case on the ordinate as a function of depth for the four illustrative cases of production wells defined in FIG. 16.
Figure 19:
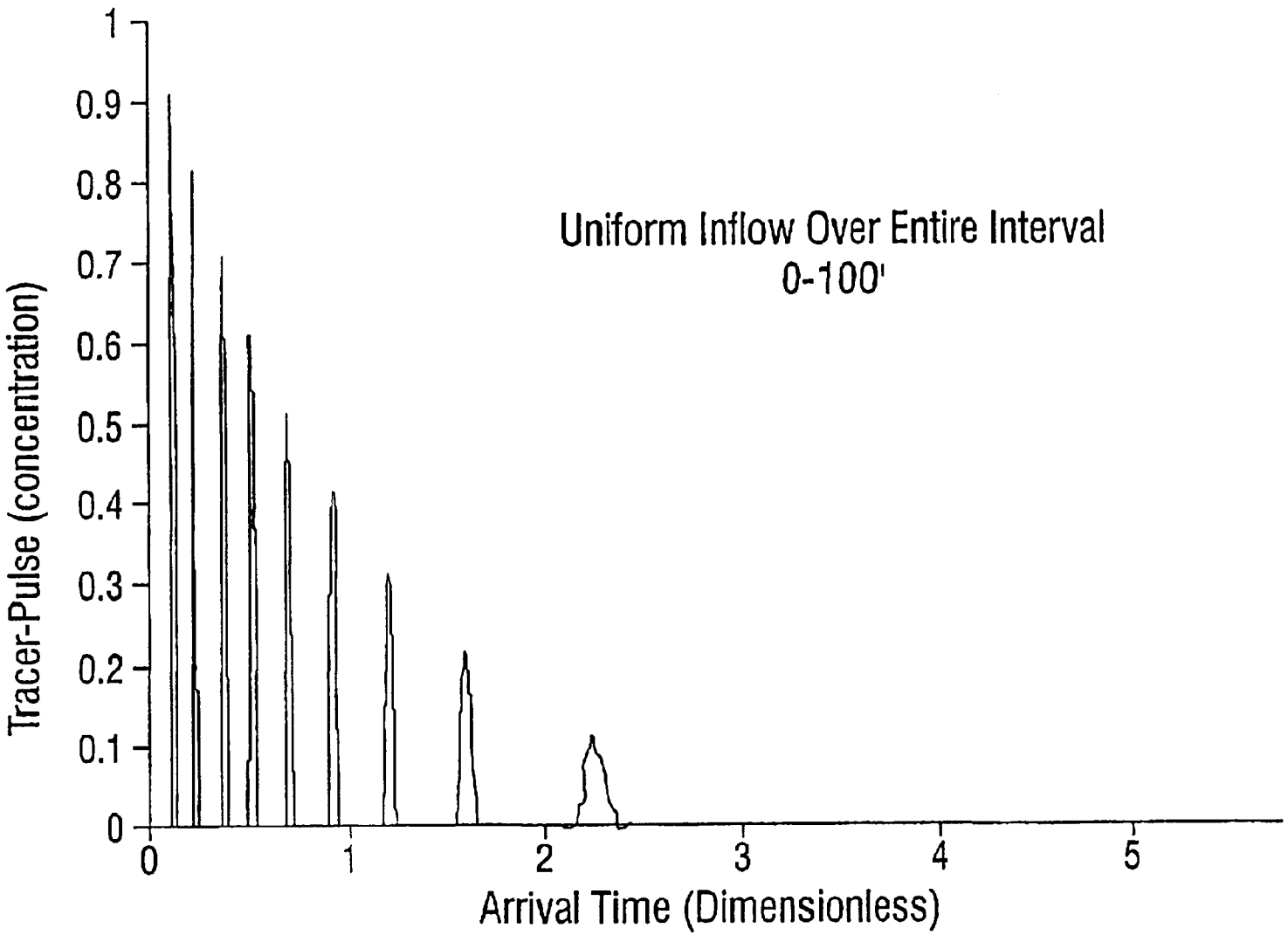
FIG. 19 graphs the relative concentration of tracer pulses on the ordinate as a function of arrival time on the abscissa for the case of uniform inflow over a producing interval.
Figure 20:
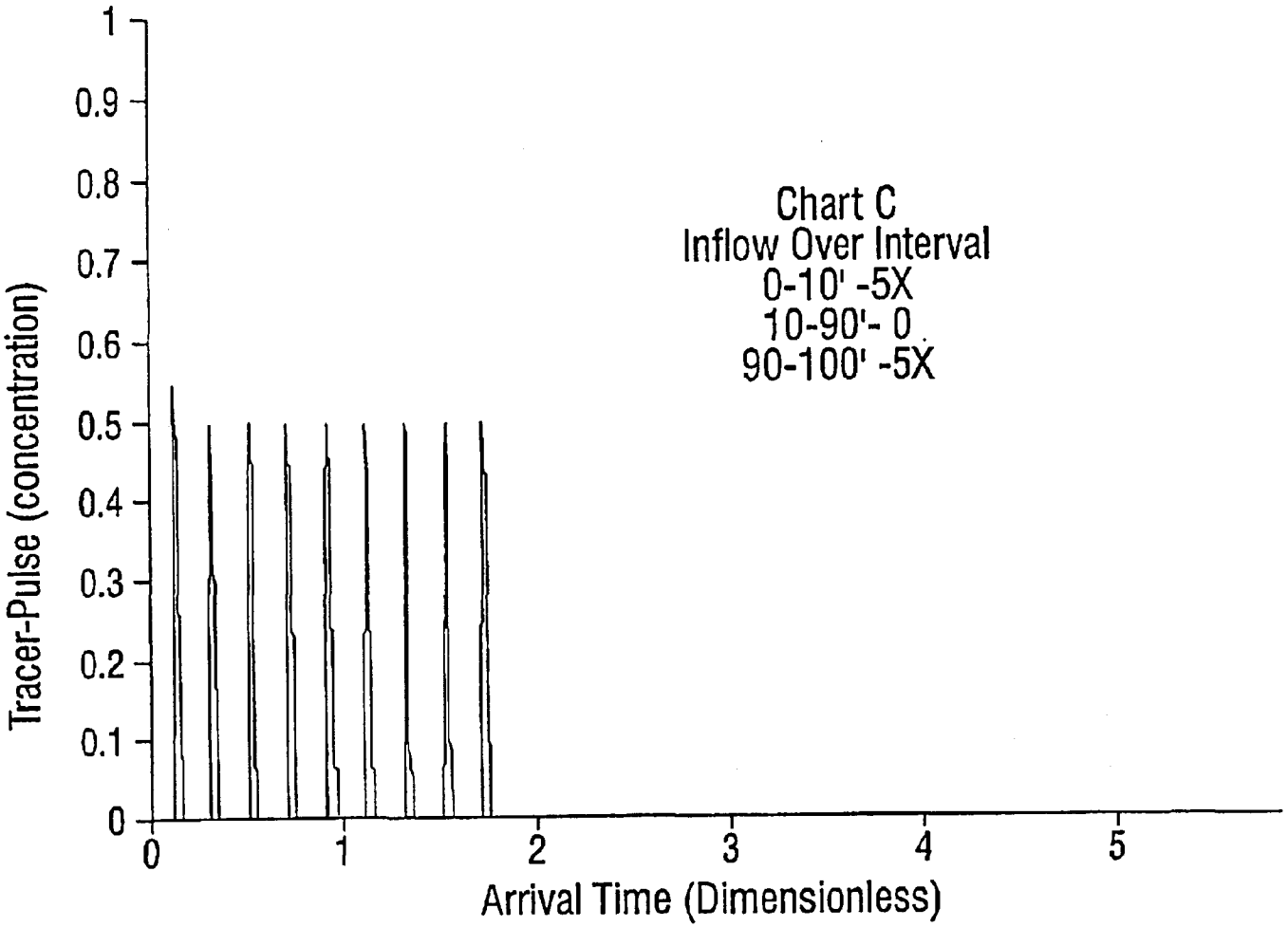
FIG. 20 graphs the relative concentration of tracer pulses on the ordinate as a function of arrival time on the abscissa for one illustrative case of non-uniform inflow over a producing interval.
Figure 21:
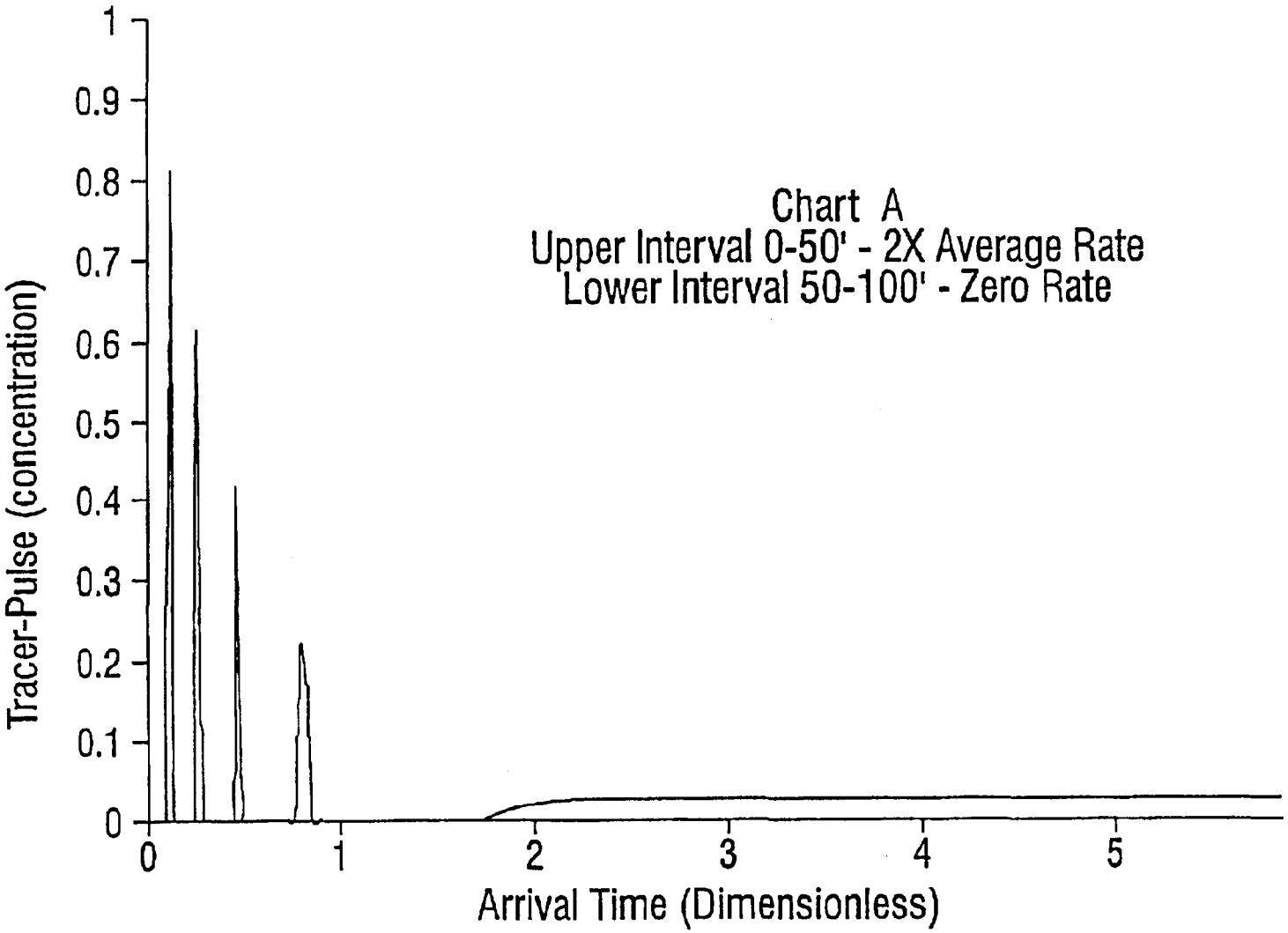
FIG. 21 graphs the relative concentration of tracer pulses on the ordinate as a function of arrival time on the abscissa for a second illustrative case of non-uniform inflow over a producing interval.
Figure 22:
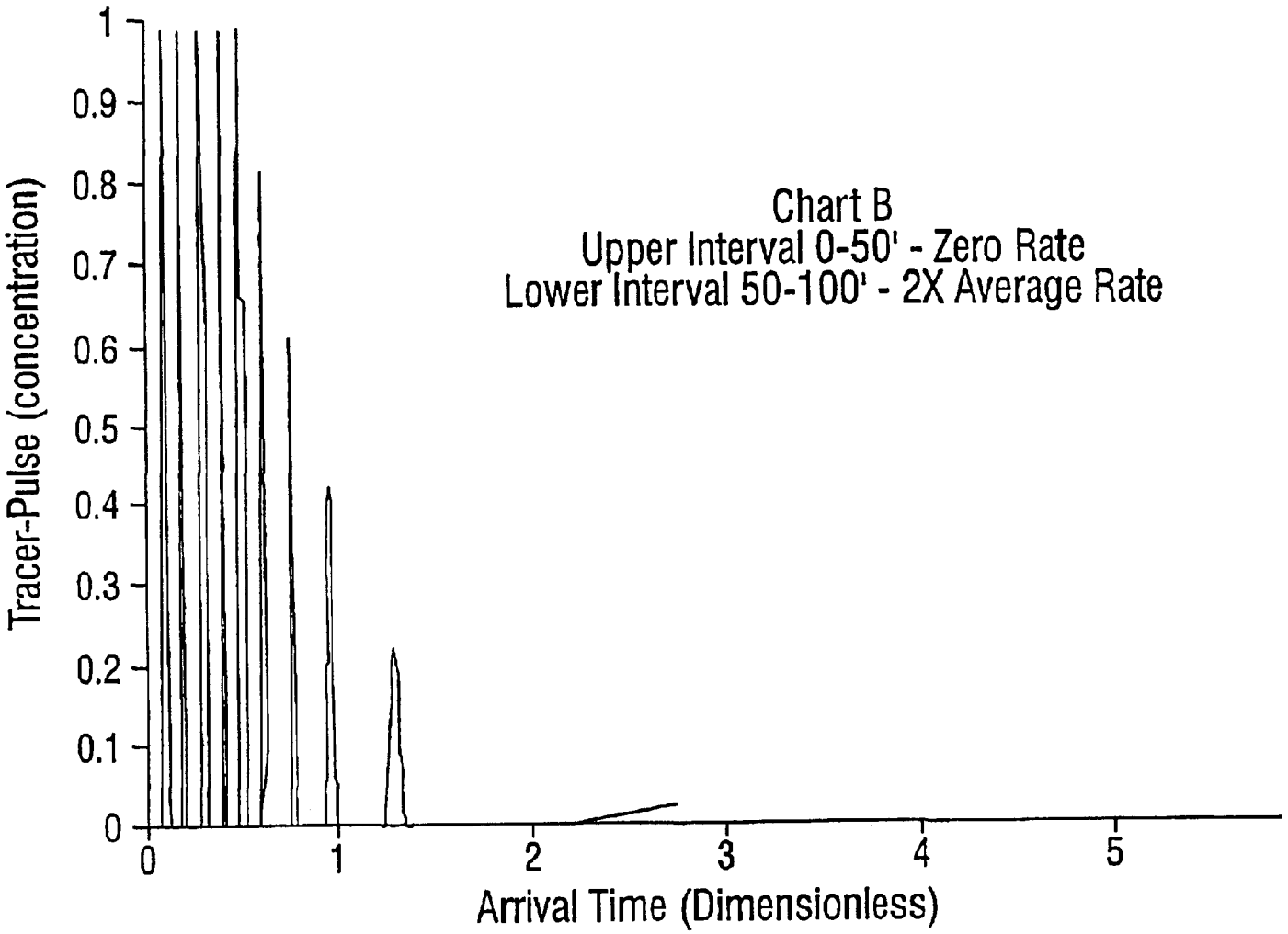
FIG. 22 graphs the relative concentration of tracer pulses on the ordinate as a function of arrival time on the abscissa for a third illustrative case of non-uniform inflow over a producing interval.

FIG. 18 shows that the shapes of the relative arrival times are distinctive for various profiles, and thus the productivity profiles may be estimated by using a series of tracer injection points spaced along the interval (see FIGS. 9A and 9B).

In addition to the arrival times, the concentration of a slug of tracer which arrives at the top of the interval from locations along the open interval can be used to verify interpretation of a productivity profile. Dilution of a tracer slug by all of the inflow of fluids above the tracer injection point is assumed, such as is calculated in column 5 of Table 1.

FIGS. 19, 20, 21, and 22 show the tracer concentrations and arrival times at the top of the formation for four profiles.

Production Wells with Long Horizontal Open Intervals

Unlike vertical wells with long completions, wells with long horizontal completions are usually completed in a single geologic layer, and hence their productivity profiles are less dependent on differences in layer permeabilities. In these wells the maintenance of uniform profiles is equally important. However, the pressure gradient along the open interval tends to result in higher production rates at the heel than at the toe of the well because greater pressure drawdown can be achieved near the vertical section (the heel). High production rates in portions of the open interval can lead to early gas coning from above the oil producing elevation, or water coning from below it. Tracer monitoring, with spaced devices in the horizontal portion (see FIGS. 9D–9G), would be useful in providing information for proper control of the inflow in these wells.

The magnitude of the high productivity at the heel can be examined by calculating the effect of a distributed inflow of fluid from the formation on the pressure drop along the well. The following calculation will illustrate the effect.

Example Horizontal Well Analysis:

L=length of entire open interval [ft]

N=number of monitor points (subsections)

$\Delta L = L/N$=spacing of monitors [ft]

n=index of subsection (from toe to heel)

$Q_N$=total flow rate from well [b/d]

$p_N$=total pressure drop over open interval [psi]

$p_H$=head loss from flow in well [(psi/ft)/(b/d)]

$dq_f$=specific inflow rate with uniform profile from formation into well [b/d/ft]

$\Delta q_f$=inflow rate from formation into a subsection of the well [b/d]

$\Delta q_n$=flow rate in the well at subsection (n) [b/d]

$\Delta p_n$=pressure drop in subsection n=$p_H(\Delta L)(\Delta q_n)$ [psi]

Assuming the well is subdivided into N well sections, from upstream (toe to heel), $$n=1, 2, 3, 4, \ldots N \tag{22}$$

With uniform inflow, $$\Delta q_f=\Delta L(Q_N/L)\ [1, 1, 1, 1, \ldots 1] \tag{23}$$

The flow rate in the well cumulates as inflow occurs from the toe to the heel, $$\Delta q_n=\Delta L(Q_N/L)\ [1, 2, 3, 4, \ldots N] \tag{24}$$

The pressure drop in each subsection is assumed proportional to the flow rate, therefore, $$\Delta p_n=\Delta L(\Delta q_n)(p_H)\ [1, 2, 3, 4, \ldots N] \tag{25}$$

Adding the pressure drops in each subsection, the total pressure drop in the well from the toe to the successively downstream subsections is $$p_n=\Sigma_1^n \Delta p_n \tag{26}$$

$$p_n=\Sigma_1^n \Delta L(\Delta q_n)(p_H)(n)(n+1)/2) \tag{27}$$

$$p_n=\Delta L(\Delta q_n)(p_H)\ [1, 3, 6, 10, 15, \ldots N(N+1)/2] \tag{28}$$

Assumptions:

length of entire open interval=2500 ft spacing of monitors=100 ft total flow rate from well=2500 b/d specific head loss in well=$10^{-4}$ psi/b/d/ft Inflow at Toe of Well No Inflow along Interval (1) For a well in which all 2500 barrels are flowing through 2500 feet of the well the pressure drop would be:

$$(Q_N)(L)(p_H)=(2500)(2500)(10^{-4})=625 \text{ psi} \tag{29}$$

Uniform Inflow (2) For a well producing uniformly along 25 subdivisions (controllable well sections), the total pressure drop in its open interval, as calculated by Equation 26 is:

$$(\Delta q_n)(\Delta L)(p_H)[N(N+1)/2]=(100)(100)(10^{-4})(25)(26)/2=325 \text{ psi} \tag{30}$$

Inflow Dependent upon Reservoir Pressure

The inflow rate into the well is proportional to the difference between the reservoir pressure and the pressure in the well. Because the pressures in the well along the open interval depend on flow rate, the inflow profile must be obtained by an iterative calculation. We define the reservoir pressure ($p_{res}$) as some pressure ($p_o$) above the highest pressure in the well, that is, the pressure at the toe.

$$p_{res}=p_o+p_{toe} \tag{31}$$

The pressure difference between the reservoir pressure and the pressure in the well at locations downstream from the toe is:

$$\Delta p_i=(p_o+p_{toe})-(p_{toe}-p_n)=p_o+p_n \tag{32}$$

$$\Delta p_i = p_o + \sum_1^i \Delta L(\Delta q_n)(p_H)((n)(n+1)/2) \tag{33}$$

In the first iteration, the cumulative flow and cumulative pressure drop along the tubing may be calculated by summing the inflow differential pressures ($p_o+p_n$) and normalizing the subsection differential pressures with that sum:

$$\text{Sum } \Delta p_i = \sum_1^N \Delta p_i \tag{34}$$

$$\text{Normalized } \Delta p_i = Pi = \frac{\Delta p_i}{\text{Sum } \Delta p_i = \sum_1^N \Delta p_i} \tag{35}$$

The inflow rate of each subsection is proportional to this normalized differential pressure, therefore, the inflow rate of each subsection is:

$$q_i=P_i(Q_N)/(\Delta L) \tag{36}$$

The cumulative flow occurring in the well is:

$$Q_i=\Sigma q_i(\Delta L), \tag{37}$$

and the cumulative pressure drop in the well from the toe to the heel is:

$$p_{n1}=\Sigma\Sigma q_i(\Delta L)(p_H) \tag{38}$$

A second iteration is made by substituting these values for the pressure drops into Equation 31. Convergence is rapid—in this case only a few iterations are needed. These can be carried out by substituting successive values of $p_{n1,2,3 \ldots}$ in Equation 34.

Figure 23:
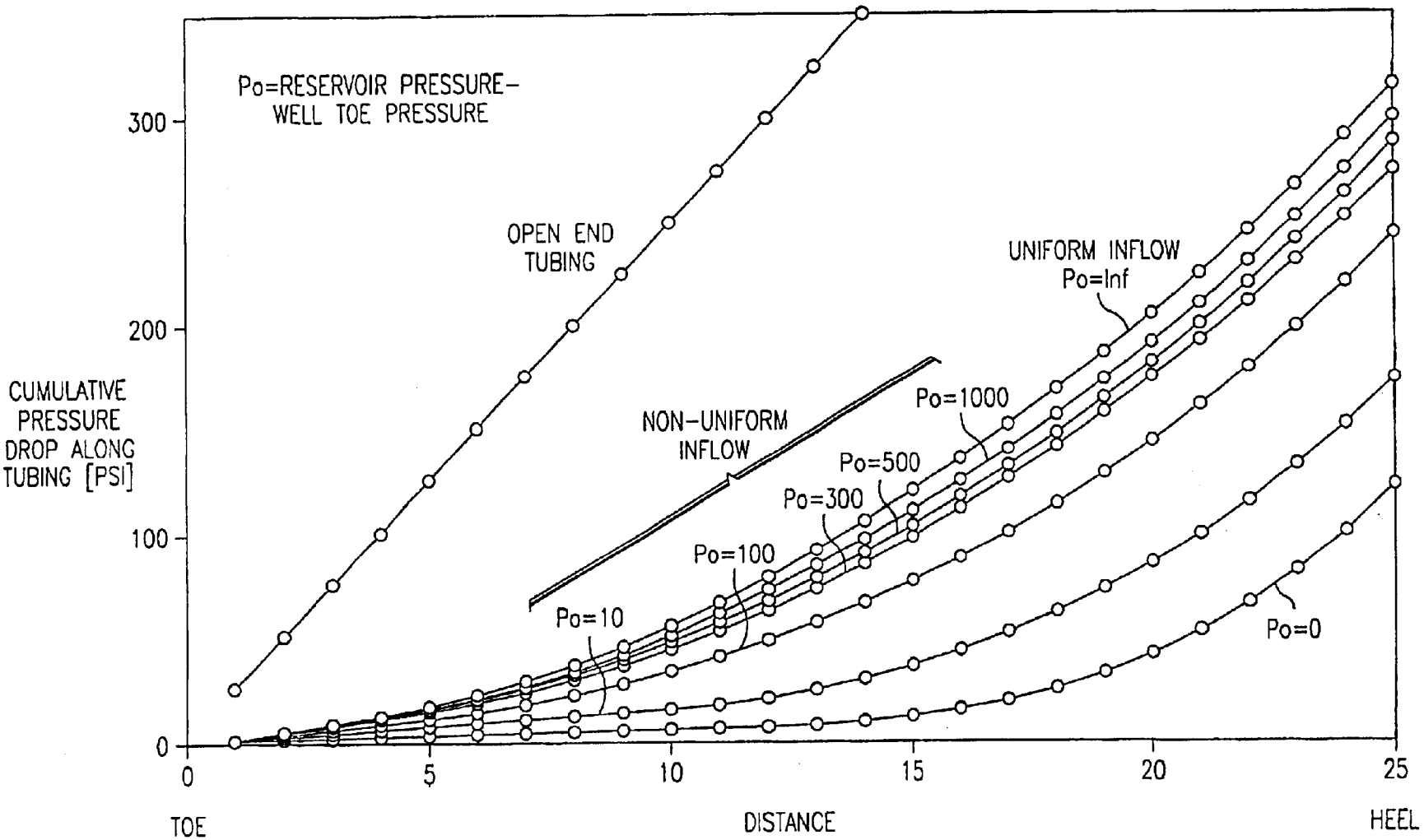
FIG. 23 graphs cumulative pressure drop along tubing on the ordinate as a function of distance along a horizontal well on the abscissa for various illustrative cases of differences between reservoir pressure and well toe pressure in horizontal completion wells.

FIG. 23 presents the results of these pressure drop calculations for several inflow conditions. When all of the flow enters the well at the toe, (Case 1—Open End Tubing), the cumulative pressure drop along the tubing is large since each section of the pipe experiences the maximum pressure drop. When flow is uniform along the length of the horizontal well section, (Case 2—Uniform Inflow), smaller pressure drops occur near the toe where flow rates in the well are low. For the same total flow rate of 2500 b/d, the uniform inflow case results in only about half the total pressure drop (325 psi) compared to Case 1, where the total pressure drop is 625 psi. When inflow is dependent on the reservoir pressure (Case 3—Non-Uniform Inflow), even lower pressure drops occur. If the reservoir pressure only slightly exceeds the well toe pressure, and the pressure drop in the well is large by comparison, then most of the inflow occurs near the heel. The lower limit occurs when the reservoir pressure equals the well toe pressure (i.e., $p_o=0$) In that case the total pressure drop is 125 psi. The upper limit, when reservoir pressure becomes large ($p_o=\infty$), results in uniform inflow.

Figure 24:
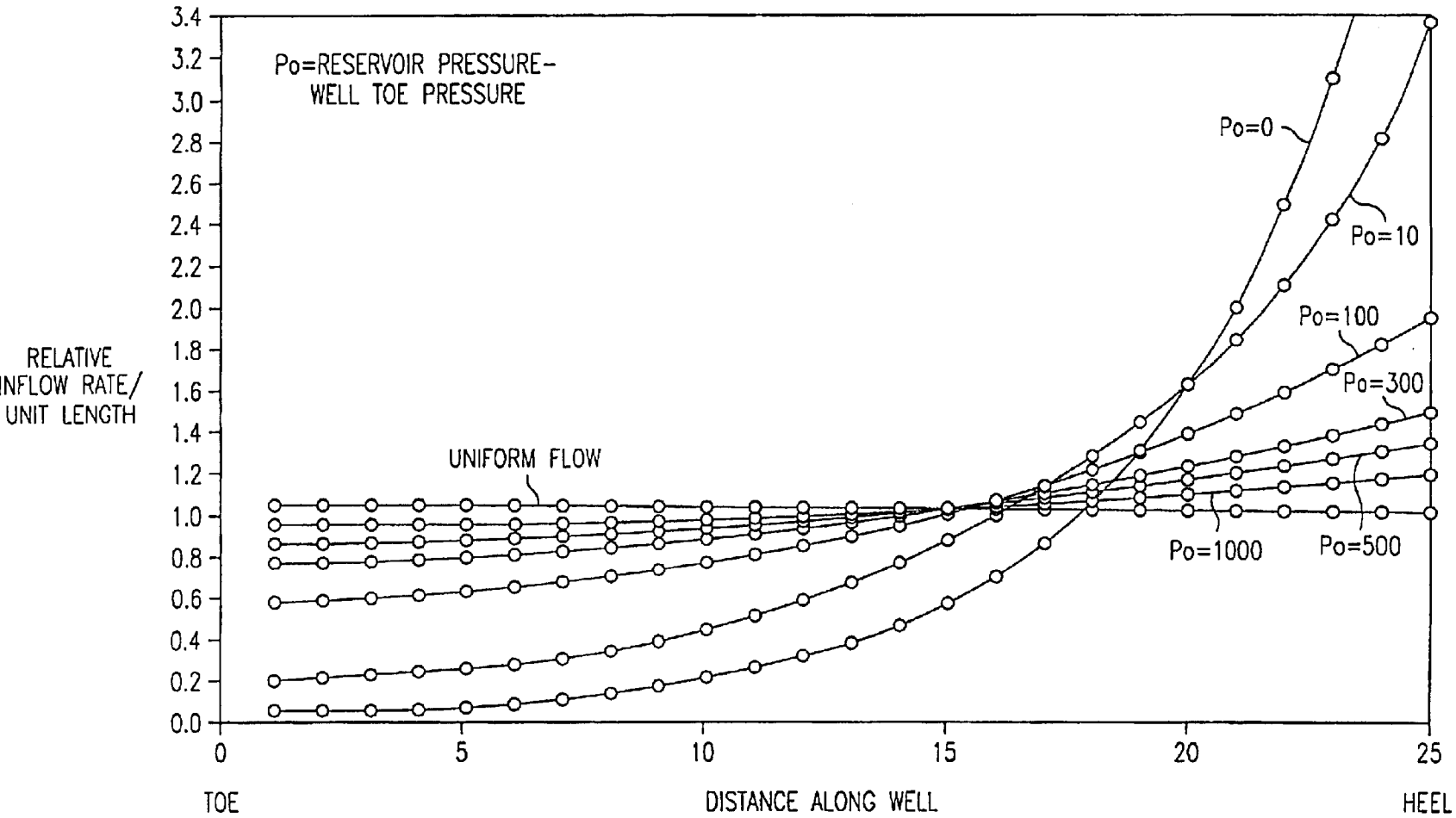
FIG. 24 graphs relative inflow rates per unit length on the ordinate as a function of distance along a horizontal well on the abscissa for various illustrative cases of differences between reservoir pressure and well toe pressure in a horizontal completion well.

FIG. 24 shows the calculated flow rates that result from various reservoir inflow conditions. The flow rates that occur along the horizontal well section under the conditions given above may be normalized with respect to the flow rates in a well with uniform inflow.

Therefore, using the present invention and the calculations provided herein, the flow streams in a production or injection well can be monitored and characterized in real time as needed. Information provided through the use of the present invention can provide more knowledge of the events occurring downhole and can be used to guide operators or a computer system in altering the production or injection procedures to optimize operations. Such uses can greatly increase efficiencies and maximize petroleum production from a given formation. The present invention also may be applied to other types of wells (other than petroleum wells), such as a water production well.

It will be appreciated by those skilled in the art having the benefit of this disclosure that this invention provides a petroleum production well having at least one electrically controllable tracer injection device, as well as methods of utilizing such devices to monitor the well production. It should be understood that the drawings and detailed description herein are to be regarded in an illustrative rather than a restrictive manner, and are not intended to limit the invention to the particular forms and examples disclosed. On the contrary, the invention includes any further modifications, changes, rearrangements, substitutions, alternatives, design choices, and embodiments apparent to those of ordinary skill in the art, without departing from the spirit and scope of this invention, as defined by the following claims. Thus, it is intended that the following claims be interpreted to embrace all such further modifications, changes, rearrangements, substitutions, alternatives, design choices, and embodiments.

The invention claimed is:

1. A tracer injection system for use in a well, comprising:

a current impedance device being generally configured for positioning about a portion of a piping structure of said well and for impeding a time-varying electrical signal conveyed along said portion of said piping structure; and a downhole, electrically controllable, tracer injection device adapted to be electrically connected to said piping structure adapted to be powered by said time varying electrical signal, and adapted to expel a tracer material into said well.

2. A tracer injection system in accordance with claim 1, wherein said current impedance device has a generally ring-shaped geometry and comprises a ferromagnetic material.

3. A tracer injection system in accordance with claim 1, wherein said piping structure comprises at least a portion of a production tubing of said well, and an electrical return comprises at least a portion of a well casing of said well.

4. A tracer injection system in accordance with claim 1, wherein said piping structure comprises at least a portion of a well casing.

5. A tracer injection system in accordance with claim 1, wherein said injection device comprises an electric motor and a communications and control module, said electrical motor being electrically connected to and adapted to be controlled by said communications and control module.

6. A tracer injection system in accordance with claim 1, wherein said injection device comprises an electrically controllable valve and a communications and control module, said electrically controllable valve being electrically connected to and adapted to be controlled by said communications and control module.

7. A tracer injection system in accordance with claim 1, wherein said injection device comprises a tracer material reservoir and a tracer injector, said tracer material reservoir being in fluid communication with said tracer injector, and said tracer injector being adapted to expel from said injection device said tracer material from within said tracer material reservoir in response to an electrical signal.

8. A tracer injection system in accordance with claim 1, wherein said electrical signal is a power signal.

9. A tracer injection system in accordance with claim 1, wherein said electrical signal is a communication signal for controlling the operation of said tracer injection device.

10. A tracer injection system in accordance with claim 1, further comprising a sensor adapted to detect said tracer material as said tracer material passes said sensor in a flow stream.

11. A tracer injection system in accordance with claim 1, further comprising a nozzle extension tube extending from said tracer injection device.

12. A petroleum well for producing petroleum products, comprising:

a piping structure disposed within the borehole of the well;

a current impedance device located about said piping structure to define an electrically conductive portion of said piping structure;

a source of time-varying signal electrically connected to said electrically conductive portion of said piping structure; and an electrically controllable tracer injection device electrically connected to said conductive portion and adapted for coupling to said time-varying signal.

13. A petroleum well in accordance with claim 12, wherein said current impedance device comprises an unpowered induction choke comprising a ferromagnetic material, such that said induction choke functions based on its size, geometry, spatial relationship to said piping structure, and magnetic properties.

14. A petroleum well in accordance with claim 12, wherein said piping structure comprises a production tubing and well casing, said time varying signal being applied to at least one of said tubing and casing.

15. A petroleum well in accordance with claim 12, wherein said tracer injection device comprises an electrically controllable valve.

16. A petroleum well in accordance with claim 12, wherein said tracer injection device comprises an electric motor.

17. A petroleum well in accordance with claim 12, wherein said tracer injection device comprises a modem.

18. A petroleum well in accordance with claim 12, wherein said tracer injection device comprises a tracer material reservoir.

19. A petroleum well in accordance with claim 12, further comprising a sensor adapted to detect a tracer material.

20. A petroleum well in accordance with claim 12, further comprising a nozzle extension tube extending from said tracer injection device.

21. A petroleum well for producing petroleum products comprising:

a well casing extending within a wellbore of said well;

a production tubing extending within said casing;

a source of time-varying electrical current located at the surface, said current source being electrically connected to, and adapted to output a time-varying current into, at least one of said tubing and said casing;

a downhole tracer injection device comprising a communications and control module, a tracer material reservoir, and an electrically controllable tracer injector, said communications and control module being electrically connected to at least one of said tubing and said casing, said tracer injector being electrically connected to said communications and control module, and said tracer material reservoir being in fluid communication with said tracer injector;

a downhole current impedance device being located about a portion of at least one of said tubing and said casing, and said current impedance device being adapted to route part of said electrical current through said communications and control module.

22. A petroleum well in accordance with claim 21, including a sensor device electrically connected to at least one of said tubing and said casing, said sensor device comprising a sensor adapted to detect a tracer material in a flow stream of said well.

23. A petroleum well in accordance with claim 21, further comprising a nozzle extension tube extending from said tracer injector.

24. A petroleum well in accordance with claim 21, wherein said tracer injector comprises an electric motor, a screw mechanism, and a nozzle, said electric motor being electrically connected to said communications and control module, said screw mechanism being mechanically coupled to said electric motor, said nozzle extending into an interior of said tubing, said nozzle providing a fluid passageway between said tracer material reservoir and said tubing interior, and said screw mechanism being adapted to drive tracer material out of said tracer material reservoir and into said tubing interior via said nozzle in response to a rotational motion of said electric motor.

25. A petroleum well in accordance with claim 21, wherein said tracer material reservoir comprises a separator therein that divides an interior of said tracer material reservoir into two volumes, and wherein said tracer injector comprises an electrically controllable valve and a nozzle, a first of said reservoir interior volumes containing a tracer material, a second of said reservoir interior volumes containing a pressurized gas such that said gas exerts pressure on said tracer material in said first volume, said electrically controllable valve being electrically connected to and controlled by said communications and control module, and said first volume being fluidly connected to an interior of said tubing via said electrically controllable valve and via said nozzle.

26. A petroleum well in accordance with claim 21, wherein said tracer material reservoir comprises a separator therein that divides an interior of said tracer material reservoir into two volumes, and wherein said tracer injector comprises an electrically controllable valve and a nozzle, a first of said reservoir interior volumes containing a tracer material, a second of said reservoir interior volumes containing a spring member such that said spring member exerts pressure on said tracer material in said first volume, said electrically controllable valve being electrically connected to and controlled by said communications and control module, and said first volume being fluidly connected to an interior of said tubing via said electrically controllable valve and via said nozzle.

27. A petroleum well in accordance with claim 21, wherein said current impedance device comprises an unpowered induction choke comprising a ferromagnetic material.

28. A petroleum well in accordance with claim 21, wherein said downhole injection device further comprises a sensor, said sensor being electrically connected to said communications and control module and said sensor being adapted to detect a tracer material.

29. A petroleum well in accordance with claim 21, wherein said communications and control module comprises a modem.

30. A method of operating a petroleum well, comprising the steps of:

providing a piping structure extending within a wellbore of said well;

applying a time-varying electrical current to said piping structure;

powering a downhole tracer injection system for said well using said time-varying electrical current applied to said piping structure; and injecting tracer material from said tracer injection system into a downhole flow stream within said well.

31. A method in accordance with claim 30, further comprising the steps of:

monitoring said flow stream at a location remote from said tracer injection device; and detecting said tracer material within said flow stream.

32. A method in accordance with claim 30, further comprising the step of:

transmitting data corresponding to said detecting steps to a surface computer system via said piping structure.

33. A method in accordance with claim 30, further comprising the step of:

locating a reservoir of tracer material in the main borehole of the well; injecting the tracer material into a lateral branch extending from the main borehole via a capillary extending into the lateral.

* * * * *